US007882781B2

(12) United States Patent
Takahashi

(10) Patent No.: US 7,882,781 B2
(45) Date of Patent: Feb. 8, 2011

(54) DUPLEX PRINTING APPARATUS HAVING CONTROL UNIT TO CONTROL PRINTING SPEED

(75) Inventor: Mituru Takahashi, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 500 days.

(21) Appl. No.: 11/772,567

(22) Filed: Jul. 2, 2007

(65) Prior Publication Data

US 2008/0121126 A1 May 29, 2008

(30) Foreign Application Priority Data

Jul. 7, 2006 (JP) ..... 2006-188142

(51) Int. Cl.
*B41L 13/16* (2006.01)
*B41L 13/04* (2006.01)

(52) U.S. Cl. ..... 101/116; 101/484; 101/118

(58) Field of Classification Search ..... 101/116, 101/484, 118; *B41L 13/16*
See application file for complete search history.

(56) References Cited

U.S. PATENT DOCUMENTS 4,791,866 A 12/1988 Kanno et al.
6,718,872 B2 4/2004 Kanno
2003/0127001 A1* 7/2003 Kanno ..... 101/116
2005/0076798 A1* 4/2005 Sato et al. ..... 101/116

FOREIGN PATENT DOCUMENTS

JP 6-28959 4/1994
JP 2003-200645 7/2003
JP 2004-26373 1/2004

* cited by examiner

*Primary Examiner*—Leslie J Evanisko
(74) *Attorney, Agent, or Firm*—Oblon, Spivak, McClelland, Maier & Neustadt, L.L.P.

(57) ABSTRACT

A duplex printing apparatus capable of printing by performing a slow-up operation on the printing speed so that it increases from a low speed to a set speed at the time of duplex printing. Control means controls, on the basis of a drum rotation position signal and a drum speed signal from a home position sensor and an unshown encoder sensor, a sheet feeding unit, printing unit, sheet discharge unit, sheet re-feeding means and switching member, such that the printing speed (drum speed) slows up from a low speed to a set speed in each rotation of a plate cylinder, which corresponds to feeding of each sheet to the printing unit when duplex printing is started, and further controls a stepping motor of the sheet re-feeding means such that conveyance speed of a sheet receiving board synchronizes with the printing speed.

8 Claims, 20 Drawing Sheets

DUPLEX PRINTING APPARATUS HAVING CONTROL UNIT TO CONTROL PRINTING SPEED

BACKGROUND OF THE INVENTION

1. Field of the Invention

The present invention relates to a duplex printing apparatus, and more particularly to a duplex printing apparatus that is capable of printing on both sides of a sheet in a single step and has a stencil printing device and the like.

2. Description of the Related Art

Digital thermal stencil printing apparatus is known as a simple printing method. In this stencil printing apparatus, a thermal head on which a number of fine heat-generating elements are arranged in a main scanning direction is brought into contact with a thermal stencil master ("master," hereinafter), and the master is conveyed in a sub-scanning direction (master conveyance direction) perpendicular to the main scanning direction, while electrifying the head-generating elements in a pulsating fashion so that the master is thermally melt-perforated in accordance with image information. This simplex master is then wrapped around an outer peripheral surface of a perforated cylindrical plate cylinder of a printing drum having the plate cylinder on the periphery thereof, whereupon a press roller or other pressing means is used to press the outer peripheral surface of the plate cylinder via a sheet of printing paper (simply referred to as "sheet" hereinafter) used as a medium to be printed. As a result, ink that is supplied to an inner periphery of the plate cylinder is transmitted through the perforated sections of the simplex master and transferred onto the sheet, whereby a printed image is obtained. Hereinafter, the printing drum is also simply referred to as "drum."

In the above-described conventional stencil printing apparatus that performs stencil printing on only one side of a sheet, the printing speed was increased (referred to as "slow-up" hereinafter) from a low speed to a set printing speed (referred to as "set speed" hereinafter) while performing printing, when starting printing. For example, in the case where the printing speed was set to the fifth speed level (120 rpm), if waiting until the printing speed becomes the fifth set speed level, latency time has occurred. For this reason, in order to respond to a user request for reducing the total printing time, a slow-up operation was performed so that the printing speed is increased by one speed level every time when one sheet is printed.

In stencil printing, in addition to simplex printing in which printing is performed on only one side of a sheet, duplex printing in which printing is performed on both sides of a sheet is often performed recently for the purpose of reducing paper consumption, the amount of space required to store documents, and the like. Therefore, Japanese Unexamined Patent Application Publication No. 2003-200645 and Japanese Unexamined Patent Application Publication No. 2004-26373, for example, propose a new duplex printing apparatus for responding to a user request for performing duplex printing.

In the duplex printing apparatuses described in these publications as well, as with the above-described stencil printing apparatus for performing stencil printing on only one side of a sheet, printing needs to be performed by performing a slow-up operation on the printing speed until the printing speed increases from a low speed to a set speed when starting duplex printing, in order to respond to a user request of reducing the total printing time.

However, in these duplex printing apparatuses, the surface-engraved image (65A) is surface-printed, and then the reverse-engraved image (65B) is reverse-printed, as described with reference to FIG. 1 through FIG. 6 and the like. However, surface printing and reverse printing are not performed on the same sheet during a single rotation of the plate cylinder (12), but are alternately performed in each rotation. Specifically, only surface printing is performed on the first sheet at the first rotation of the plate cylinder (12) when starting duplex printing. Then, surface printing on the second sheet and reverse printing on the abovementioned first sheet turned by a rotation/turning effect of the press roller (13) are performed simultaneously and continuously at the second rotation of the plate cylinder (12). Surface printing and reverse printing are not performed on the same sheet during a single rotation of the plate cylinder (12).

Specifically, the duplex printing apparatus having the above-described configuration did not take into consideration the slow-up operation for increasing the printing speed to the set speed.

SUMMARY OF THE INVENTION

The present invention, therefore, is contrived in view of such circumstances, and it is the main object of the present invention to provide a duplex printing apparatus capable of performing printing by performing slow-up operation until the printing speed increases from a low speed to a set speed at the time duplex printing.

It is another object of the present invention to provide a duplex printing apparatus capable of achieving the effects and advantages described later.

In an aspect of the present invention, a duplex printing apparatus comprises a printing device, which has a plate cylinder around which a duplex master is wrapped, the duplex master having two images of a first engraved image and a second engrave image formed next to each other along a direction of rotation of the plate cylinder, and a pressing device capable of being attached/detached with respect to the plate cylinder in a relative manner; a sheet feeding device for feeding a sheet toward the printing device; a sheet discharging device for discharging a printed sheet printed by the printing device; a sheet re-feeding device for temporarily holding a surface-printed sheet, the front side of which is formed with a printed image by the printing device so as to correspond to the first engraved image or the second engraved image, thereafter sending the surface-printed sheet to the pressing device, and turning the surface-printed sheet by means of rotation of the pressing device to re-feed the surface-printed sheet to the printing device; a switching device for guiding the sheet, which has passed through the printing device, to the sheet re-feeding device or the sheet discharging device; and a control device for controlling a drive unit of the sheet feeding device, printing device, sheet discharging device, sheet re-feeding device and switching device respectively, so that printing speed slows up from a low speed to a set speed when duplex printing is started. At the time of duplex printing, a first sheet is fed to the printing device by the sheet feeding device to perform, on the front side of the first sheet, surface printing corresponding to either one of the first engraved image and the second engrave image, thus obtained first surface-printed sheet on which printing is performed is guided to the sheet re-feeding device by the switching device, thereafter a second sheet is fed to the printing device by the sheet feeding device to perform, on the front side of the second sheet, surface printing corresponding to either one of the first engraved image and the second engraved image, and to re-feed the first surface-printed sheet to the printing device by means the sheet re-feeding device to perform, on the reverse side of the first surface-printed sheet, reverse printing corresponding to the other one of the first engraved image and the second engraved image, and thus obtained first duplex-printed sheet is guided to the sheet discharging device by the switching device, while thus obtained second surface-printed sheet is guided to the sheet re-feeding device.

BRIEF DESCRIPTION OF THE DRAWINGS

The above and other objects, features, and advantages of the present invention will become more apparent from the following detailed description taken with the accompanying drawings, in which.

DESCRIPTION OF THE PREFERRED EMBODIMENTS

Figure 1:
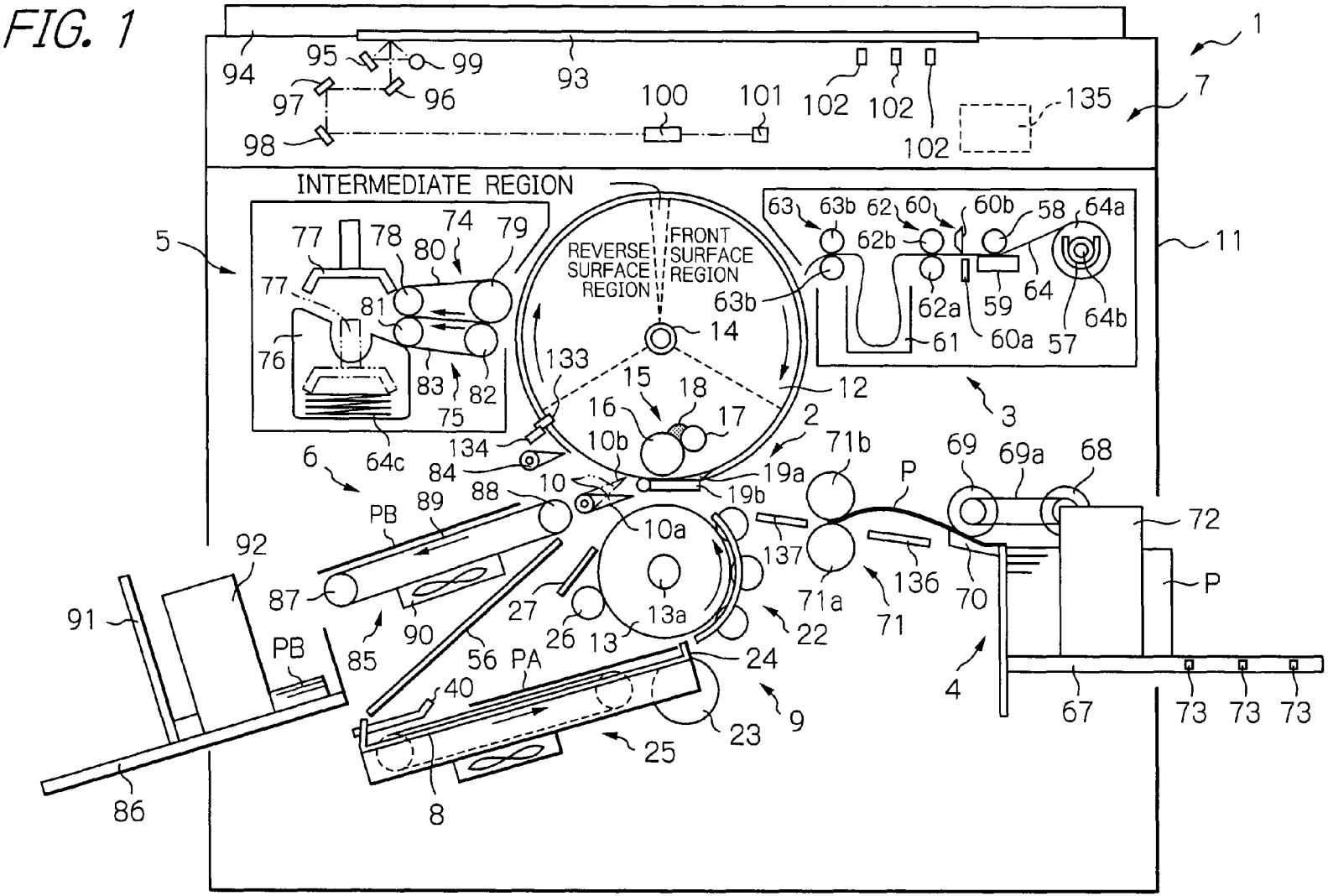
FIG. 1 is a front view showing the schematic configuration of a duplex printing apparatus related to the first embodiment to which the present invention is applied.

The embodiments of the present invention (referred to as "embodiment(s)" hereinafter) including the best modes and examples for implementing the present invention are described hereinafter with reference to the drawings.

Throughout the embodiments, like reference characters are used to indicate the components (members and elements) having the same functions, shapes and the like, after these components are explained. Therefore, the overlapping explanations are omitted accordingly. When the explanations are provided with reference to the components of the patent application publications and the like, such explanations are provided by adding the reference characters having parenthesis, to distinguish the components described in these publications including the abovementioned prior arts from those of each embodiment of the present invention.

A duplex printing apparatus 1 according to the first embodiment to which the present invention is applied is described with reference to FIG. 1 through FIG. 13.

First of all, the entire configuration of the duplex printing apparatus 1 is described with reference to FIG. 1. In this drawing the duplex printing apparatus 1 has a printing unit 2 as printing means, an engraving unit 3, a sheet feeding unit 4 as sheet feeding means, a plate discharge unit 5 as plate discharging means, a sheet discharge unit 6 as sheet discharging means, an image reading unit 7, an auxiliary tray 8, sheet re-feeding means 9 having a sheet receiving board 40 and the like, a switching member 10 as switching means, and so on.

These components constituting the units/means of the duplex printing apparatus 1 are substantially the same as the components described in, for example, the abovementioned Japanese Unexamined Patent Application Publication No. 2004-26373, except that a drive mechanism of a press roller and the name and the like of a multiple-step cam are different from those shown in FIG. 1 through FIG. 9, FIG. 16 and FIG. 17 of the abovementioned publication. The present invention relates to slow-up operation control on the printing speed when starting duplex printing, thus, from this standpoint, the explanations on the configurations of the above units/means that are remotely related to the present invention are omitted accordingly.

The printing unit 2 that is disposed substantially in the center of an apparatus main body 11 has a printing drum 12 (simply referred to as "plate cylinder 12" or "drum" hereinafter) having a plate cylinder on an outer peripheral section thereof, and a press roller 13 serving as pressing means that is freely attached to or detached from the plate cylinder 12.

The plate cylinder 12 is mainly constituted by a pair of end plates, not shown, that are supported rotatably around a spindle 14 serving as an ink supply pump, a perforated supporting plate, not shown, which is wrapped around an outer peripheral surface of each end plate, and a mesh screen, not shown, that is wrapped around an outer peripheral surface of the unshown perforated supporting plate. The plate cylinder 12 is rotary driven by a main motor (not shown) constituting plate cylinder drive means 121 (see FIG. 9) and is constituted so as to be detachable with respect to the apparatus main body 11. In this first embodiment the plate cylinder 12 has a size so as to be able to handle up to an A3-size printed matter at the time of simplex printing.

The unshown main motor is constituted by, for example, a DC motor, and is coupled to the plate cylinder 12 via drive force transmission means such as a gear, and to the press roller 13 via an endless belt, pulley or other drive force transmission means. The rotation speed of the main motor is controlled by control means 129 shown in FIG. 9 via a motor drive circuit, not shown, whereby the rotation speed of the plate cylinder 12, i.e., the printing speed, can be varied in five levels from a low speed of 60 rpm to a high speed of 120 rpm with increasing interval of 15 rpm.

Ink supply means 15 is disposed on the inside of the plate cylinder 12. The ink supply means 15 has the spindle 14, an ink roller 16, a doctor roller 17, and the like.

The ink roller 16 is supported rotatably between unshown side plates provided within the plate cylinder 12. The ink roller 16 is also disposed such that a peripheral surface thereof is brought close to an inner peripheral surface of the plate cylinder 12, and is rotary driven by drive means, not shown, in the same direction as the plate cylinder 12. The doctor roller 17 is also supported rotatably between the side plates. The doctor roller 17 is disposed such that a peripheral surface thereof is brought close to the peripheral surface of the ink roller 16, and is rotary driven by the unshown drive means in the direction opposite to that of the plate cylinder 12. The spindle 14 is provided with a plurality of small holes so that ink supplied from the spindle 14 accumulates in a cross-sectionally wedge-shaped space formed in a section where the ink roller 16 and the doctor roller 17 are adjacent to each other. As a result, an ink pool 18 is formed.

A stage section 19*a* forming a flat surface along a bus line of the plate cylinder 12 is formed on the outer peripheral surface of the plate cylinder 12. A clamper 19*b* for holding a leading edge of a master on the outer peripheral surface of the plate cylinder 12 is disposed openably on the stage section 19*a*. The clamper 19*b* is opened and closed by opening/closing means, not shown, which is provided on the apparatus main body 11 side, when the plate cylinder 12 is rotated to a predetermined position.

Figure 2:
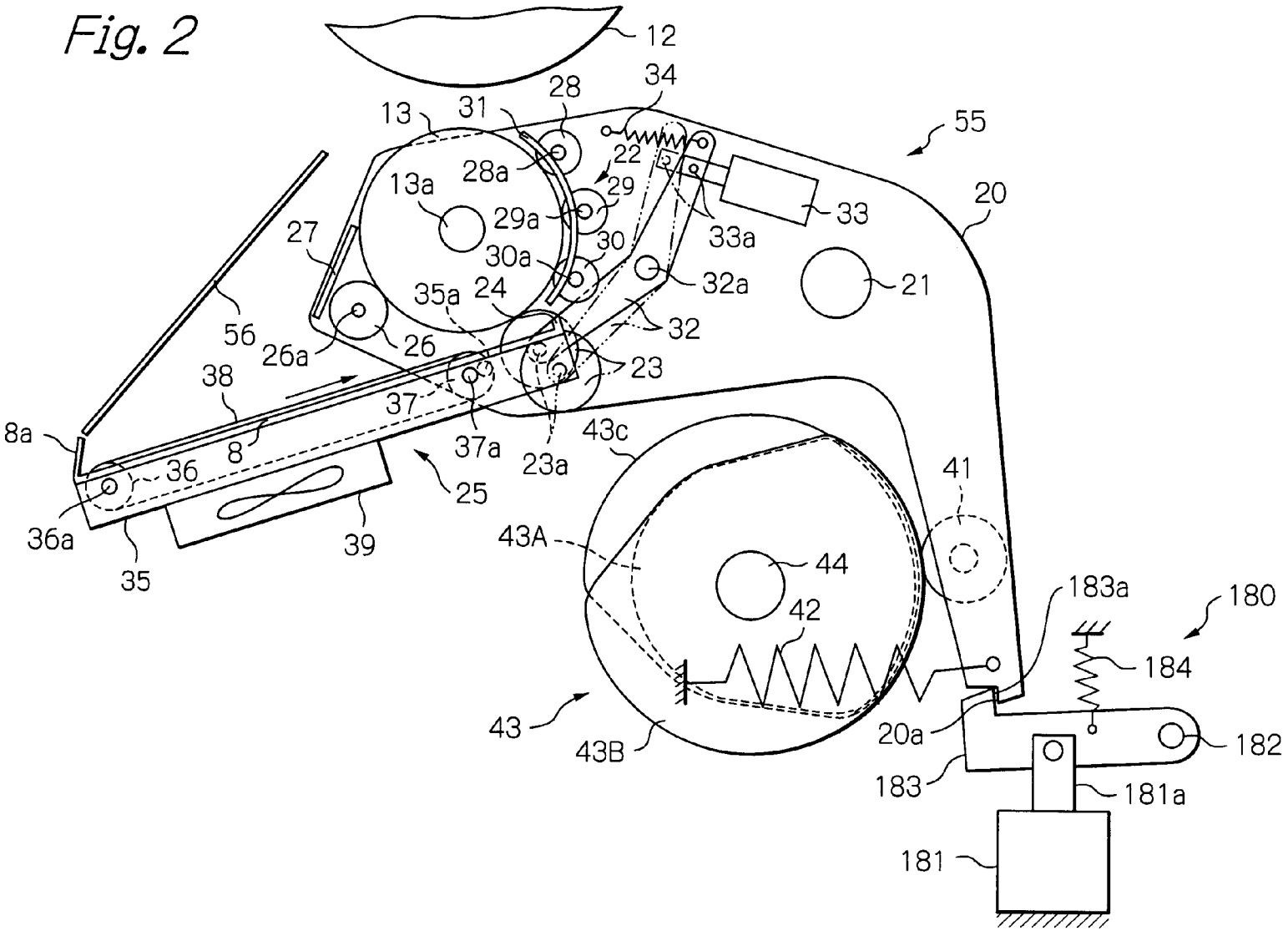
FIG. 2 is a front view showing the schematic configuration of a press roller attaching/detaching mechanism and a press roller which is separated from an outer peripheral surface of a plate cylinder.

The press roller 13 is disposed below the plate cylinder 12. The press roller 13 is configured such that an oil resistant elastic body such as nitrile rubber (NBR) is wrapped around a metallic core section (axis section) 13*a*, and the press roller 13 is extended in an axis line direction of the spindle 14 of the plate cylinder 12. In the press roller 13 both ends of the core section 13*a* are supported rotatably by a pair of arm members 20, as shown in FIG. 2. Each of the arm members 20 having a shape of substantially a letter "L" is integrated by a pivot shaft 21 attached to a section in the vicinity of a bent section of the arm member 20, and the pivot shaft 21 is supported rotatably or swingably by the apparatus main body 11 within a range of predetermined angles. In the present embodiment, at least a peripheral surface of the press roller 13 is constituted by an ink repellent member such as polytetrafluoroethylene resin.

An outer peripheral surface of the press roller 13 not only is constituted by the ink repellent member but also may be coated or adhered uniformly with glass beads such as glass particles that are used for repelling dirt and stains on a printed matter in an offset printing machine, for example. Not only glass particles but also ceramic particles may be used. Accordingly, swelling and ink blot that are caused when the press roller 13 comes into contact with the outer peripheral surface of the plate cylinder 12 or a duplex master 65 or simplex master 66 on the plate cylinder 12 can be minimized.

The press roller 13 is coupled to the main motor via the unshown drive force transmission means such as a toothed endless belt or pulley, and is rotary driven by the main motor at circumferential speed that is substantially the same as the circumferential speed of the plate cylinder 12, as described above partially. The unshown toothed pulley on the driving side that rotary drives the press roller 13 is supported rotatably by the pivot shaft 21. The rotary force of the plate cylinder 12 is transmitted to the driving pulley via the unshown drive force transmission means having the same configuration as the plate cylinder drive means (80) shown in, for example, FIG. 2 of Japanese Unexamined Patent Application Publication No. 2001-191627 (e.g., a row of gears, or a combination of the pulley and endless belt). The core section 13*a* of the press roller 13 is provided with a toothed driven pulley that is rotatably provided so as to transmit the drive force only in the counterclockwise direction shown by the arrow in the figure, via a one-way clutch, which is not shown. The toothed endless belt is extended between the driving pulley and the driven pulley.

It should be noted that the drive mechanism of the press roller 13 not only is configured as described above but also may be driven and rotated by the same plate cylinder (12) as shown in FIG. 1 and the like of Japanese Unexamined Patent Application Publication No. 2004-26373 mentioned above.

As shown in FIG. 2, not only the press roller 13 but also a sheet re-feeding guidance member 22, a sheet re-feeding resist roller 23, a sheet re-feeding positioning member 24, a sheet re-feeding conveyance unit 25, a cleaning roller 26, a guide plate 27, and the like are provided between the arm member 20.

The sheet re-feeding guidance member 22 and a sheet guide plate 31 are the same as those described in the paragraphs "0026" and "0027" of Japanese Unexamined Patent Application Publication No. 2004-26373 mentioned above.

The sheet re-feeding resist roller 23 serving as a sheet re-feeding resist member is disposed below the press roller 13. The roller-like sheet re-feeding resist roller 23 is supported rotatably on a spindle 23*a*, and the spindle 23*a* is attached to one end of a swing arm 32. The swing arm 32 is supported on a spindle 32*a* fixedly installed between the arm members 20, so as to swing freely at the bent section of the swing arm 32. The position where the swing arm 32 is disposed is defined such that the sheet re-feeding resist roller 23 is positioned in substantially the center of a width direction of the press roller 13, and such that the swing arm 32 itself is positioned in the middle of the position where each of rollers 30 is disposed.

The other end of the swing arm 32 is attached with a plunger 33*a* of a pull-type solenoid 33 attached to one of the arm members 20 via a bracket, which is not shown, and one end of a tension spring 34 is fixed to one of the arm members 20, and the other end of the tension sprint 34, which that applies a rotary biasing force to the swing arm 32 in the counterclockwise direction in FIG. 2 with the spindle 32*a* as a center, is fixed to the abovementioned other end of the swing arm 32. In this configuration, the sheet re-feeding resist roller 23 occupies a pressing position in which a peripheral surface of the solenoid 33 is pressed against the peripheral surface of the press roller 13 by a predetermined pressing force when the solenoid 33 is ON/activated (simply described as "activated or switched ON" hereinafter), the pressing position being shown by the solid line in FIG. 2, and occupies a release position in which the peripheral surface of the solenoid 33 is released from the peripheral surface of the press roller 13 by the biasing force of the tension spring 34, the release position being shown by a two-dot chain line in FIG. 2, when the activation of the solenoid 33 is OFF/canceled (simply described as "canceled or switched OFF" hereinafter).

The sheet re-feeding conveyance unit 25 is disposed on the lower left side of the press roller 13. The sheet re-feeding conveyance unit 25 has a conveyance unit main body 35, a driving roller 36, a driven roller 37, an endless belt 38 serving as a sheet conveyance member, a suction fan 39 and the like, and has the auxiliary tray 8 on an upper surface thereof integrally. The auxiliary tray 8 functions as sheet re-feeding storing means for temporarily storing sheets that have been printed on the front sides thereof by the printing unit 2.

The conveyance unit main body 35 as a housing, an upper surface of which is opened and width of the same is formed to be slightly narrower than the space between the arm members 20, has unshown bearings on both an upstream side and a downstream side of the sheet conveying direction, and the unshown bearings rotatably support a driving shaft 36*a* and a driven shaft 37*a* respectively. Each end of the driving shaft 36*a* passes through each side face of the conveyance unit main body 35, and each end passing through is rotatably supported on an unshown bearing member provided on the apparatus main body 11. Further, one of the ends of the driving shaft 36*a* is attached with an unshown driving gear, and the driving shaft 36*a* is rotary driven by a conveyance unit drive motor 122 provided in the apparatus main body 11 (see FIG. 9). Each end of the driven shaft 37*a* is configured so as not to pass through each side face of the conveyance unit main body 35.

A boss 35*a* is integrally provided on the outside of each side face of the upstream end of the sheet conveying direction of the conveyance unit main body 35. Each boss 35*a* is loosely fitted to an unshown long hole formed on each arm member 20. In this configuration, the conveyance unit main body 35 can swing around the driving shaft 36*a* along with the swinging motion of each arm member 20, when the press roller 13 is attached and detached with respect to the plate cylinder 12 by a press roller attaching/detaching mechanism 55, which will be described later.

The plurality of roller-like driving rollers 36 are integrally attached to the driving shafts 36*a* respectively, and a predetermined space is provided between the driving rollers 36. The plurality of driven rollers 37 having the same shape as the driving rollers 36 are integrally attached to the driven shafts 37*a* respectively, with the same space therebetween as the driving rollers 36. The endless belt 38 is extended between a driving roller 36 and a corresponding driven roller 37 at a predetermined tension. The driving shaft 36*a* is rotary driven by the conveyance unit drive motor 122, whereby the endless belt 38 composed of a frictional resistance member is moved in a direction shown by the arrow in FIG. 2.

Figure 3:
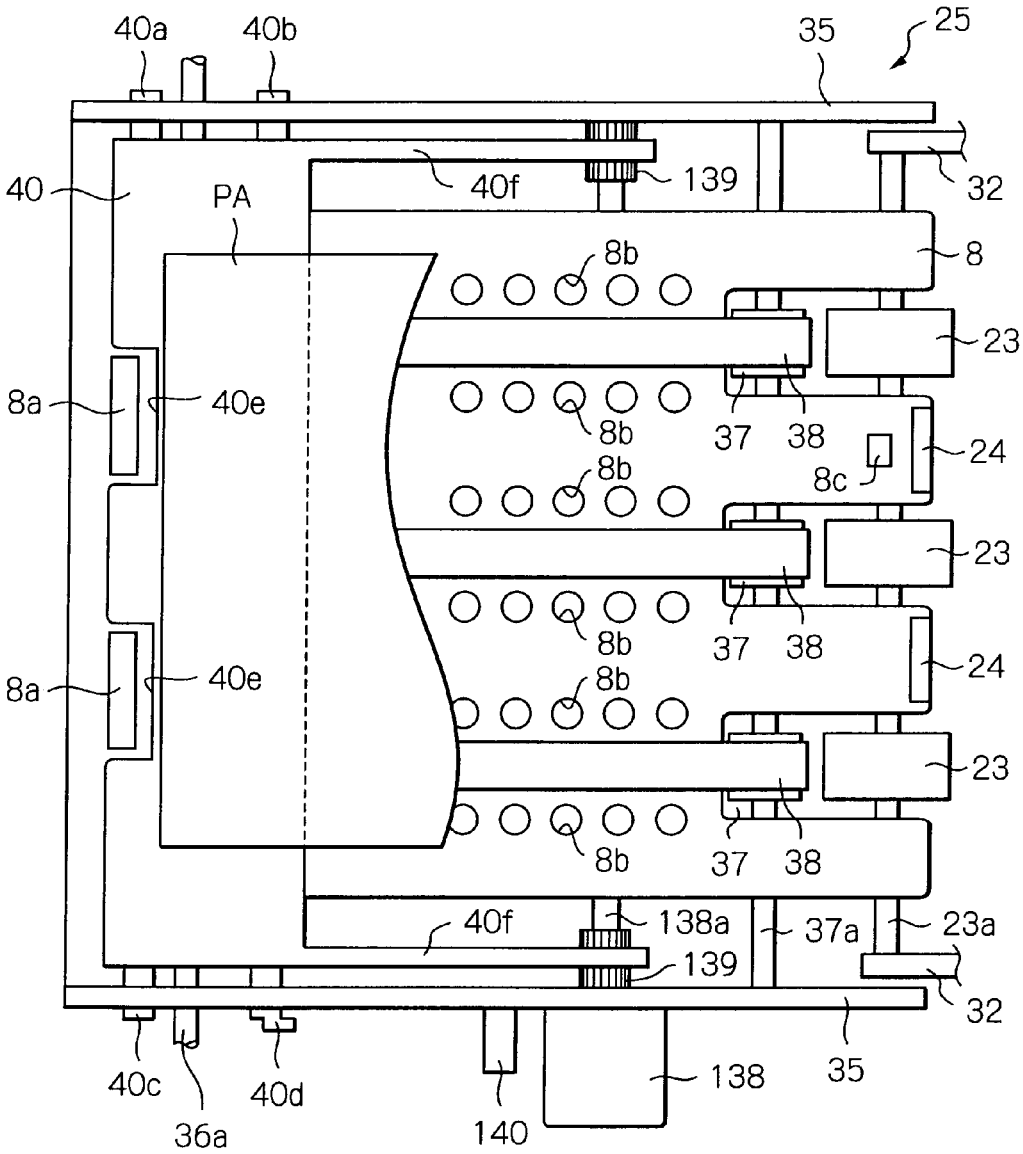
FIG. 3 is a plan vie showing the schematic configuration of a re-feeding conveyance unit and of a sheet receiving board of the duplex printing apparatus.

The suction fan 39 is integrally attached to a lower surface of the conveyance unit main body 35, and the auxiliary tray 8 is integrally attached to the upper surface of the conveyance unit main body 35. The auxiliary tray 8 is configured such that a part of the peripheral surface of each of the rollers 36 and 37 faces a sheet conveyance surface, as shown in FIG. 3. A plurality of holes 8*b* are formed on both sides of each endless belt 38 on the sheet conveying surface. A downstream end of the sheet conveying direction is provided integrally with two end fences 8*a* for catching one end of a sheet PA, which has been delivered from the printing unit 2 and printed on the front side thereof.

The sheet re-feeding positioning member 24 for temporarily stopping, at a fixed position, the other end of the surface-printed sheet PA to be re-fed to the printing unit 2 by the sheet re-feeding conveyance unit 25 is disposed at the upstream end, in the sheet conveying direction, of the auxiliary tray 8. In the present embodiment two sheet re-feeding positioning members 24 are provided, and the auxiliary tray 8 is integrally attached to each of the sheet re-feeding positioning members 24. Moreover, a sensor 8*c*, which serves as a surface-printed sheet detecting member for detecting that the other end of the surface-printed sheet PA approaches the sheet re-feeding positioning member 24, is disposed on the auxiliary tray 8. When the sensor 8*c* detects the other end of the surface-printed sheet PA, the sensor 8*c* outputs a signal to the control means 129 which will be described later.

The lower surface of the conveyance unit main body 35, which is the surface attached with the suction fan 39, is provided with a hole section that is not shown. Accordingly, the suction fan 39 is activated, whereby negative pressure is generated inside of the conveyance unit main body 35, which is the housing, and the surface-printed sheet PA is drawn to the upper surface of each moving endless belt 38. The suction force of the suction fan 39 and the frictional resistance force of the endless belt 38 are set to the extent that slippage is caused between the surface-printed sheet PA and each endless belt 38 when the other end of the surface-printed sheet PA abuts on the sheet re-feeding positioning member 24.

The sheet re-feeding means 9 is constituted by the above-mentioned auxiliary tray 8, sheet re-feeding guidance member 22, sheet re-feeding resist roller 23, sheet re-feeding positioning member 24 and sheet re-feeding conveyance unit 25. Also, the sheet re-feeding means 9 has the sheet receiving board 40 as the sheet receiving board shown in FIG. 1 and FIG. 3 and other components, thus this sheet receiving board 40 and the like will be described later.

The cleaning roller 26 for cleaning the peripheral surface of the press roller 13 is disposed in the section located in the vicinity of the press roller 13 and above the sheet re-feeding conveyance unit 25. The cleaning roller 26 is the same as the one described in the paragraphs "0038" and "0039" of Japanese Unexamined Patent Application Publication No. 2004-26373 mentioned above.

The guide plate 27 is disposed on the upper left side of the cleaning roller 26. Both ends of the guide plate 27 made of a plate material are fixedly provided in each arm member 20, and the guide plate 27 guides the surface-printed sheet PA delivered from the printing unit 2, toward the auxiliary tray 8 without causing the surface-printed sheet PA to contact the cleaning roller 26. The guide plate 27 is disposed on a position proximate to the peripheral surfaces of the press roller 13 and the cleaning roller 26.

A rotatable cam follower 41 is disposed on the other end side of each arm member 20, which is opposite to the one end supporting the press roller 13, in a manner that the cam followers 41 face the outside. Also, a print pressure spring 42 is attached at one end to the apparatus main body 11 at the other end to each arm member 20 in the vicinity of the position where the cam followers 41 of each arm member 20 are disposed. As a result, each arm member 20 is applied with a rotary biasing force in the clockwise direction in the figure, with the pivot shaft 21 as a center.

Figure 4:
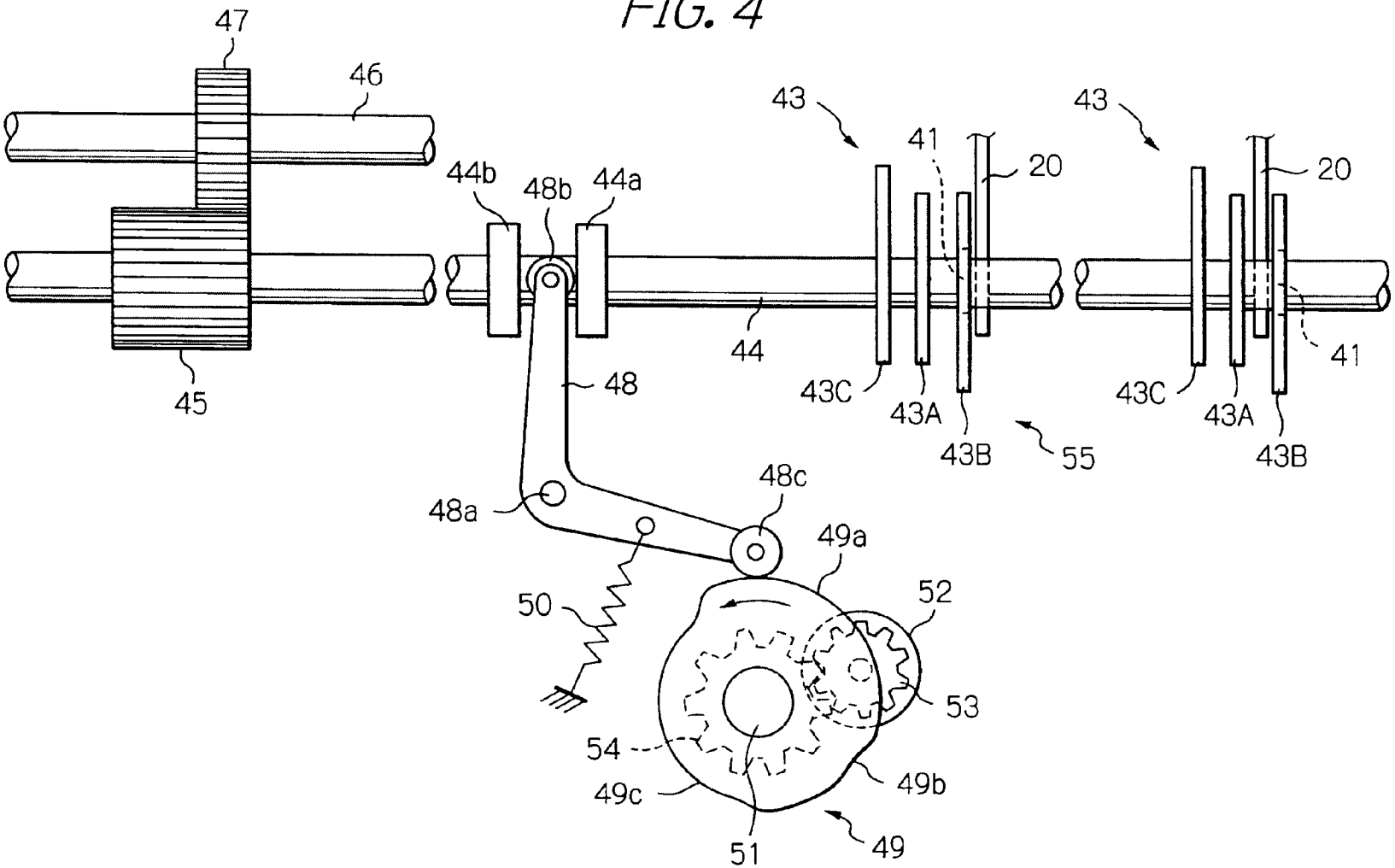
FIG. 4 is a side view showing the schematic configuration of the press roller attaching/detaching mechanism.

A multiple-step cam 43 having three cam plates 43A, 43B and 43C is disposed in the vicinity of the left side of each cam follower 41. The cam plates 43A, 43B and 43C are spaced from each other by a predetermined distance and fixed to a cam shaft 44, which is supported movably in a sheet surface direction in FIG. 2 and both ends of which are rotatably supported on the apparatus main body 11. The cam plate 43B, the cam plate 43A, and the cam plate 43C are disposed in this order from the front of the apparatus. Each of the cam plates 43A, 43B and 43C has a disk-like base section concentric with the cam shaft 44, and a projecting section (large diameter section); the projecting amount of the cam plates are equal in amount to each other. As shown in FIG. 4, a rotary force is transmitted from the plate cylinder drive means 121 to the multiple-step cam 43 via a drive gear 45 attached to the cam shaft 44 and a transmission gear 47 that is attached to a spindle 46 supported rotatably on the apparatus main body 11, whereby the multiple-step cam 43 is rotary drive in the clockwise direction in FIG. 2.

The press roller 13 occupies the release position shown in FIG. 2 in which, when any one of the projecting sections of the cam plates 43A, 43B and 43C is brought into contact with the cam follower 41, the peripheral surface of the press roller 13 is released from the peripheral surface of the plate cylinder 12. The press roller 13 occupies the pressing position shown in FIG. 5 in which, when the contact between any one of the projecting sections and the com follower 41 is canceled, the peripheral surface of the press roller 13 is pressed against the peripheral surface of the plate cylinder 12 by the biasing force of the print pressure spring 42. Each of the cam plates 43A, 43B and 43C is configured such that the base section thereof is not brought into contact with the cam follower 41 when the press roller 13 occupies the pressing position. Regarding the shape of the projecting sections of each of the cam plates 43A, 43B and 43C, the projecting section of the cam plate 43A is formed such that the area of contact between the press roller 13 and the plate cylinder 12 becomes a range obtained by combining all of the front surface region, intermediate region and reverse surface region shown in FIG. 1, the projecting section of the cam plate 43B is formed such that the area of contact becomes the same size as the front surface region, and the projecting section of the cam plate 43C is formed such that the area of contact becomes a range obtained by combining a downstream section of the front surface region, the intermediate region and the reverse surface region. Also, the cam plates 43A, 43B and 43C are spaced from each other by a distance significantly greater than the plate thickness of the arm member 20.

In FIG. 2, press roller locking means 180 for preventing each arm member 20 from swinging in a state in which the press roller 13 occupies the release position is disposed in the vicinity of the right side of each arm member 20.

The press roller locking means 180 has a hook member 183 one end of which is fixed to a spindle 182 supported on the apparatus main body 11 so as to be able to freely rotate a predetermined angle, a pull-type print pressure solenoid 181 having a plunger 181*a* coupled to the other end of the hook member 183 via a pin, and a tension spring 184 serving as biasing means, one end of which is locked to the hook member 183 between the spindle 182 and the pin, and the other end of which is locked to the apparatus main body 11. A hook section 183*a* that is selectively engaged with a cutout section 20*a* formed on the other end of the arm member 20 is formed on the other end of the hook member 183. The tension spring 184 swings and biases the hook section 183*a* of the hook member 183 in the clockwise direction with the spindle 182 as a center, i.e., in a direction for constantly engaging them with the cutout section 20*a* of the arm member 20.

Figure 5:
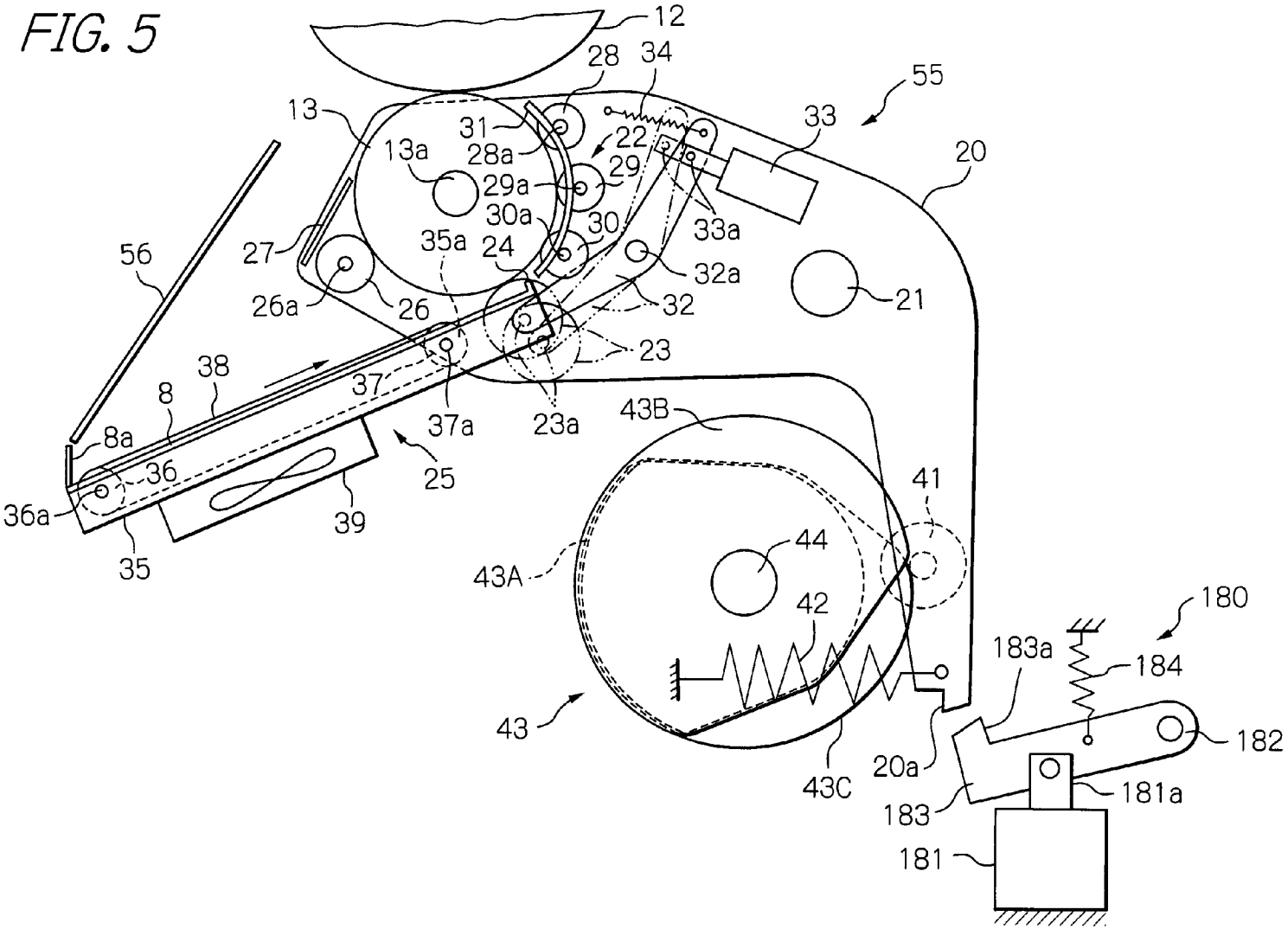
FIG. 5 is a front view showing the schematic configuration of the press roller attaching/detaching mechanism and the press roller that is in contact with the outer peripheral surface of the plate cylinder.

By controlling ON and OFF of the print pressure solenoid 181, a state of holding each arm member 20 and a state of canceling the same are selectively switched. As shown in FIG. 5, when the print pressure solenoid 181 is electrified and thereby activated, the hook section 183*a* is swung in the counterclockwise direction and downward, engagement between the arm member 20 and the cutout section 20*a* is released, each arm member 20 swings in the clockwise direction and upward with the pivot shaft 21 as a center, and print pressure is applied to the plate cylinder 12 by the biasing force of the print pressure spring 42 via the press roller 13. The print pressure solenoid 181 is activated in a state in which the cam follower 41 is in contact with the projecting section of any one of the cam plates 43A, 43B and 43C.

As shown in FIG. 4, a moving arm 48 and a stepped cam 49 are disposed in the vicinity of the lower side of the cam shaft 44. A bent section of the substantially L-shaped moving arm 48 is attached to a spindle 48*a*, which is rotatably supported on the apparatus main body 11. A roller 48*b* and a cam follower 48*c* are rotatably attached to one end and the other end of the arm 48, respectively. A tension spring 50 is attached at one end to the apparatus main body 11 and at the other end to a section between the other end and bent section of the arm 48, thereby rotary biasing the moving arm 48 in the clockwise direction in the figure, with the spindle 48*a* as a center.

The roller 48*b* is disposed between disks 44*a* and 44*b* that are attached to the intermediate section of the cam shaft 44 and spaced from each other. A peripheral surface of the cam follower 48*c* is caused to abut against a peripheral surface of the stepped cam 49 by the biasing force of the tension spring 50. The space between the disks 44*a* and 44*b* is set to be slightly greater than the diameter of the roller 48*b*.

The stepped cam 49 has three cam sections 49*a*, 49*b* and 49*c* on its peripheral surface and is fixed to a spindle 51 that is rotatably supported on the apparatus main body 11. A gear 53 and a gear 54 held in mesh with the gear 53 that are attached to the output shaft of a stepping motor 52 attached to the apparatus main body 11 are attached the spindle 51. The stepped cam 49 is rotary driven in the direction shown by the arrow in FIG. 4 by activating the stepping motor 52. In this configuration, when the stepping motor 52 is activated and thereby the stepped cam 49 is rotated, the moving arm 48 swings around the spindle 48*a* and causes the roller 48*b* to push the disk 44*a* or 44*b*, thereby causing the cam shaft 44 to move in the right-and-left direction in FIG. 4.

Each of the cam sections 49*a*, 49*b* and 49*c* is configured so as to move the cam shaft 44 in the following manner. That is, when the cam follower 48*c* and the cam section 49*a* come into contact with each other, the cam plate 43B is moved to a position where it can contact the cam follower 41. When the cam follower 48*c* and the cam section 49*b* come into contact with each other, the cam plate 43A is moved to a position where it can contact the cam follower 41. Also, when the cam follower 48*c* and the cam section 49*c* come into contact with each other, the cam plate 43C is moved to a position where it can contact the cam follower 41.

The cam follower 41, print pressure spring 42, multiple-step cam 43, press roller locking means 180, moving arm 48, stepped cam 49 and stepping motor 52 constitute the press roller attaching/detaching mechanism 55. The activation of the press roller attaching/detaching mechanism 55 selectively causes the press roller 13 to occupy the release position shown in FIG. 2 and the pressing position shown in FIG. 5. The print pressure solenoid 181 of the press roller locking means 180 and the stepping motor 52 constitute drive means of the press roller attaching/detaching mechanism 55.

A switching member 10 for switching the sheet conveyance path of the sheet P is disposed on the sheet conveyance path of the sheet P at the left-hand side of the position where the plate cylinder 12 and the press roller 13 come into contact with each other (nip forming position). The switching member 10 functions as switching means for guiding a sheet, which has passed through the printing unit 2, to the sheet re-feeding means 9 or sheet discharge unit 6. The switching member 10 is made of a plate material having substantially the same width as the plate cylinder 12 and press roller 13 and is fixed to a spindle at its downstream end of the sheet conveying direction, the spindle being supported swingably on the apparatus main body 11. When a solenoid 123 (see FIG. 9)

is activated, the upstream end of the sheet conveying direction that is formed into a cross-sectionally acute angle is selectively located at a first displacement position indicated by the solid line in FIG. 1 and a second displacement position indicated by the two-dot chain line in the same drawing.

At the first displacement position, the switching member 10 is placed in a position where a leading edge thereof is brought close to the peripheral surface of the press roller 13 but does not interfere with the clamper 19*b* placed on the plate cylinder 12. At the second displacement position, the switching member 10 is placed in a position where the leading edge thereof is brought close to the peripheral surface of the plate cylinder 12. When the switching member 10 occupies the first displacement position, the surface-printed sheet PA that has passed through the nip between the plate cylinder 12 and the press roller 13 is guided to the sheet discharge unit 6. When the switching member 10 occupies the second displacement position, the surface-printed sheet PA is guided to the auxiliary tray 8 via the path between the guide plate 27 and a guide plate 56 fixed to the apparatus main body 11.

The engraving unit 3 is disposed in the upper right section of the apparatus main body 11. The engraving unit 3 has a master holding member 57, a platen roller 58, a thermal head 59, cutting means 60, a master stocking section 61, a pair of tension rollers 62, a pair of turn rollers 63 and the like. The engraving unit 3 engraves a image on a master 64, which will be described later, to thereby create the duplex master 65 having a first engraved image 65A and a second engraved image 65B shown in FIG. 6, or a simplex master 66 having a third engraved image 66A having a image volume area for both first engraved image 65A and the second engraved image 65B. The third engraved image 66A has an area that is the sum of the two image areas of the first engraved image 65A and second engraved image 65B. The first engraved image 65A is formed at a position corresponding to the front surface region shown in FIG. 1, when the duplex master 65 is wrapped around the outer peripheral surface of the plate cylinder 12. Also, the second engraved image 65B is formed at a position corresponding to the reverse surface region.

The detailed configurations that constitute the engraving unit 3, including the master holding member 57, platen roller 58, thermal head 59 serving as engraving means, cutting means 60 having a stationary blade 60*a* and a movable blade 60*b* movably supported on the stationary blade 60*a*, master stocking section 61, pair of tension rollers 62 constituted by a driving roller 62*a* and a driven roller 62*b*, and pair of turn rollers 63 constituted by a driving roller 63*a* and a driven roller 63*b*, are the same as those described in, for example, the paragraphs "0052" through "0058" of Japanese Unexamined Patent Application Publication No. 2004-26373, thus the explanations thereof are omitted.

Figure 9:
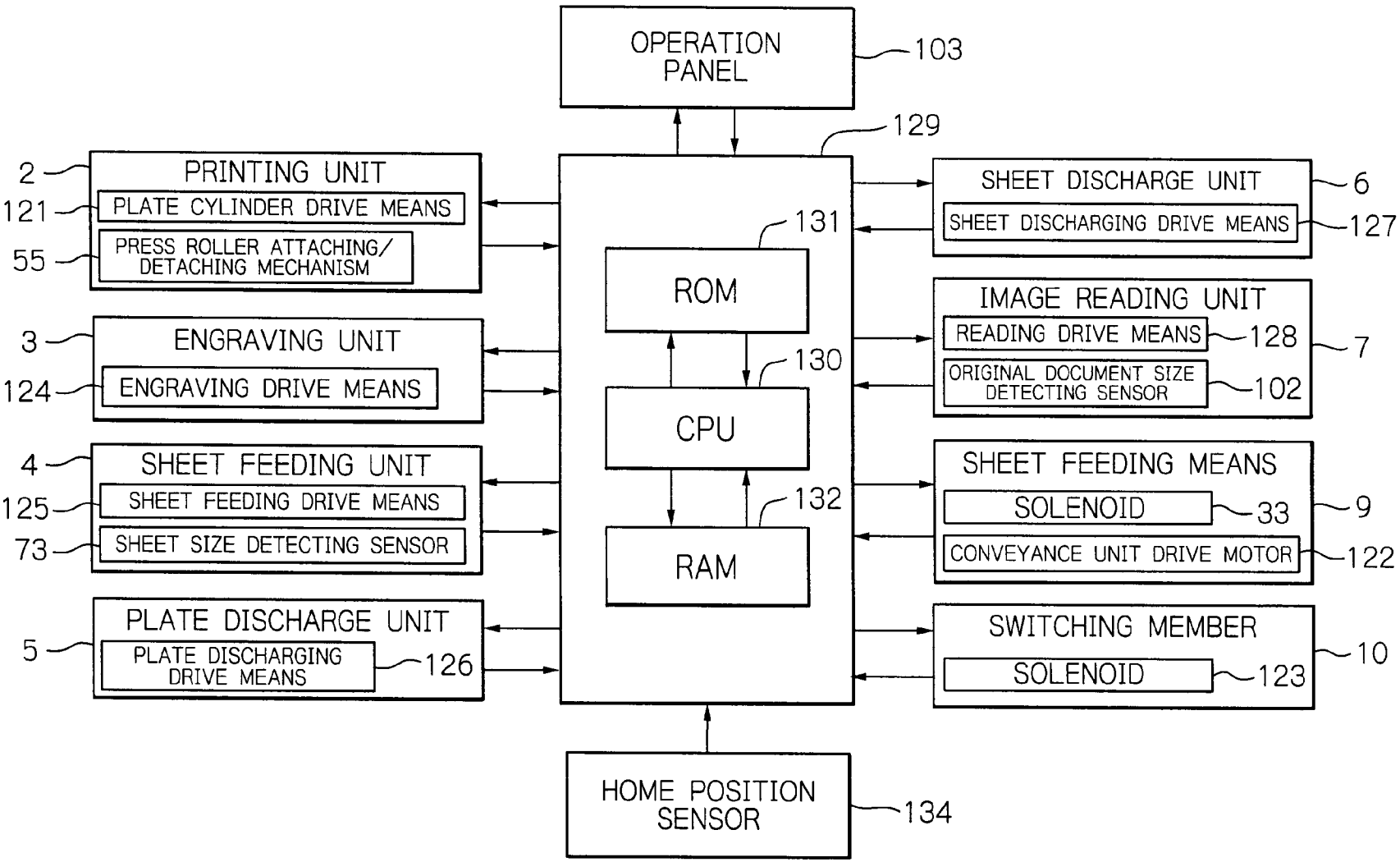
FIG. 9 is a block diagram showing the configuration of control means of the duplex printing apparatus.

The driving configurations including an unshown stepping motor for rotary driving the platen roller 58, tension roller pair 62, and turn roller pair 63, and the driving configuration for driving the rest of the components of the engraving unit 3 are generically called "engraving drive means 124" (see FIG. 9).

The sheet feeding unit 4 is disposed below the engraving unit 3. The sheet feeding unit 4 has a sheet feeding board 67, a sheet size detecting sensor 73 disposed on the sheet feeding board 67, a sheet feeding roller 68, a separating roller 69, a separating pad 70, a pair of resist rollers 71 and the like.

The sheet feeding board 67 capable of stacking a large number of sheets P on the upper surface thereof is supported on the apparatus main body 11 so as to be able to freely move vertically, and is vertically moved by sheet feeding drive means 125 having lifting means (see FIG. 9). The upper surface of the sheet feeding board 67 on which a sheet P of A3 size can be placed in a profile position is provided with a pair of side fences 72 that are movably supported by an unshown rail member in a sheet width direction perpendicular to the sheet conveying direction. Furthermore, a free end of the sheet feeding board 67 is provided with a plurality of sheet size detecting sensors 73 for detecting the size of the stacked sheets P.

The sheet feeding roller 68 having a high frictional resistance member on the surface thereof is disposed above the sheet feeding board 67. The sheet feeding roller 68 is rotatably supported on the unshown bracket that is swingably supported on the apparatus main body 11. When the sheet feeding board 67 is lifted up by the unshown lifting means, the sheet feeding roller 68 is pressed against the top sheet P on the sheet feeding board 67 by a predetermined pressing force. The sheet feeding roller 68 is then rotary driven by the sheet feeding drive means 125.

The separating roller 69 and the separating pad 70, each of which has a high frictional resistance member on the surface thereof, are disposed on the left side of the sheet feeding roller 68. The separating roller 69 is operatively connected to the sheet feeding roller 68 via a timing belt 69*a*, and is rotary driven in synchronization with and in the same direction as the sheet feeding roller 68 when the sheet feeding roller 68 is rotary driven. The separating pad 70 is pressed against the separating roller 69 by the biasing force of biasing means, which is not shown.

The pair of resist rollers 71 are disposed on the left side of the separating roller 69 and of the separating pad 70. A rotary drive force is transmitted from the plate cylinder drive means 121 via unshown drive force transmission means, such as gears and a cam, to the resist roller pair 71 made up of a driving roller 71*a* and a driven roller 71*b*, whereby the driving roller 71*a* is rotated at a predetermined timing in synchronization with the plate cylinder 12, and cooperates with the driven roller 71*b* pressed against the driving roller 71*a* to feed the sheet P toward the printing unit 2 at a predetermined timing.

Sheet feeding guide plates 136, 137 for guiding conveyance of the sheet P fed from the sheet feeding unit 4 to the printing unit 2 are disposed respectively on the upstream side and the downstream side of the sheet conveying direction of the resist roller pair 71. Each of the sheet feeding guide plates 136 and 137 is fixed between unshown side plates of the apparatus main body 11.

The plate discharge unit 5 is disposed on the upper left side of the printing unit 2. The plate discharge unit 5 has an upper plate discharge member 74 constituted by a driving roller 78, driven roller 79, endless belt 80 and the like, a lower plate discharge member 75 constituted by a driving roller 81, driven roller 82, endless belt 83 and the like, a plate discharge box 76, a compression plate 77, and the like. The detailed configurations of these components are the same as those described in, for example, the paragraphs "0064" and "0065" of Japanese Unexamined Patent Application Publication No. 2004-26373, thus the explanations thereof are omitted. The driving configurations for driving these components of the plate discharge unit 5 are generically called "plate discharge drive means 126" (see FIG. 9).

The sheet discharge unit 6 is disposed below the plate discharge unit 5. The sheet discharge unit 6 has a sheet discharging conveyance unit 85 constituted by a peeling pawl 84, driving roller 87, driven roller 88, endless belt 89, suction fan 90 and the like, and a catch tray 86.

A plurality of peeling pawls 84 are disposed in the width direction of the plate cylinder 12, and are integrally attached to the spindle that is swingably supported on the apparatus main body 11. The plurality of peeling pawls 84 are swung by pawl swinging means, not shown, and selectively occupy a position shown in the figure where the leading edge of each of the peeling pawls is brought closed to the peripheral surface of the plate cylinder 12, and a position where the leading edge is released from the outer peripheral surface of the plate cylinder 12 for avoiding obstacles such as the clamper 19*b*. A drive force is transmitted from the plate cylinder drive means 121 to the unshown pawl swinging means via drive force transmission means, not shown, whereby the peeling pawl 84 is swung in synchronization with the rotation of the plate cylinder 12.

The sheet feeding conveyance unit 85 is disposed below the peeling pawl 84 at the left-hand side of the switching member 10, and has the driving roller 87, driven roller 88, endless belt 89, suction fan 90 and the like. A plurality of the roller-like driving rollers 87 are attached to an unshown spindle supported rotatably on an unshown unit side plate and are spaced from each other by a predetermined interval. Sheet discharging drive means 127 having a sheet discharging motor and the like (see FIG. 9) causes the driving rollers 87 to rotate integrally with each other. A plurality of the driven rollers 88 are also provided on the unshown spindle supported rotatably on the same side plate and are spaced from each other by the same interval as that of the driving rollers 87. The endless belt 89 is extended over each driving roller 87 and each corresponding driven roller 88. The suction fan 90 is disposed below the driving roller 87, driven roller 88 and endless belt 89. The sheet discharging conveyance unit 85 draw the sheet P onto the endless belt 89 by means of the suction force of the suction fan 90, and a printed sheet PB is conveyed in a direction of the arrow shown in FIG. 1 by the rotation of each driving roller 87.

The catch tray 86 for stacking, on the upper surface thereof, the printed sheet PB that has been conveyed by the sheet discharging conveyance unit 85 has one end fence 91 that is movable in the sheet conveying direction, and a pair of side fences 92 that are movable in the sheet width direction.

The image reading unit 7 is disposed in an upper part of the apparatus main body 11. The image reading unit 7 has a contact glass 93 on which an original document is placed, a pressure plate 94 provided so as to be free to contact and separate from the contact glass 93, reflection mirrors 95, 96, 97, 98 and a fluorescent lamp 99 for scanning and reading an image of the original document, a lens 100 for condensing the scanned image of the original document, an image sensor 101 such as CCD for processing the condensed image, a plurality of original document size detecting sensors 102 for detecting the size of the original document, an image memory 135 for storing read image data, and the like. The operation of reading the image of the original document is executed by reading drive means 128 (see FIG. 9).

Moreover, as shown in FIG. 1, a dog 133 is attached to an outer periphery of an unshown end plate constituting the plate cylinder 12. A home position sensor 134 is attached to the apparatus main body 11 in the vicinity of the plate cylinder 12. When the plate cylinder 12 occupies a position where the clamper 19*b* faces the press roller 13, the home position sensor 134 detects the dog 133 and outputs a signal toward the control means 129, which will be described later.

Figure 8:
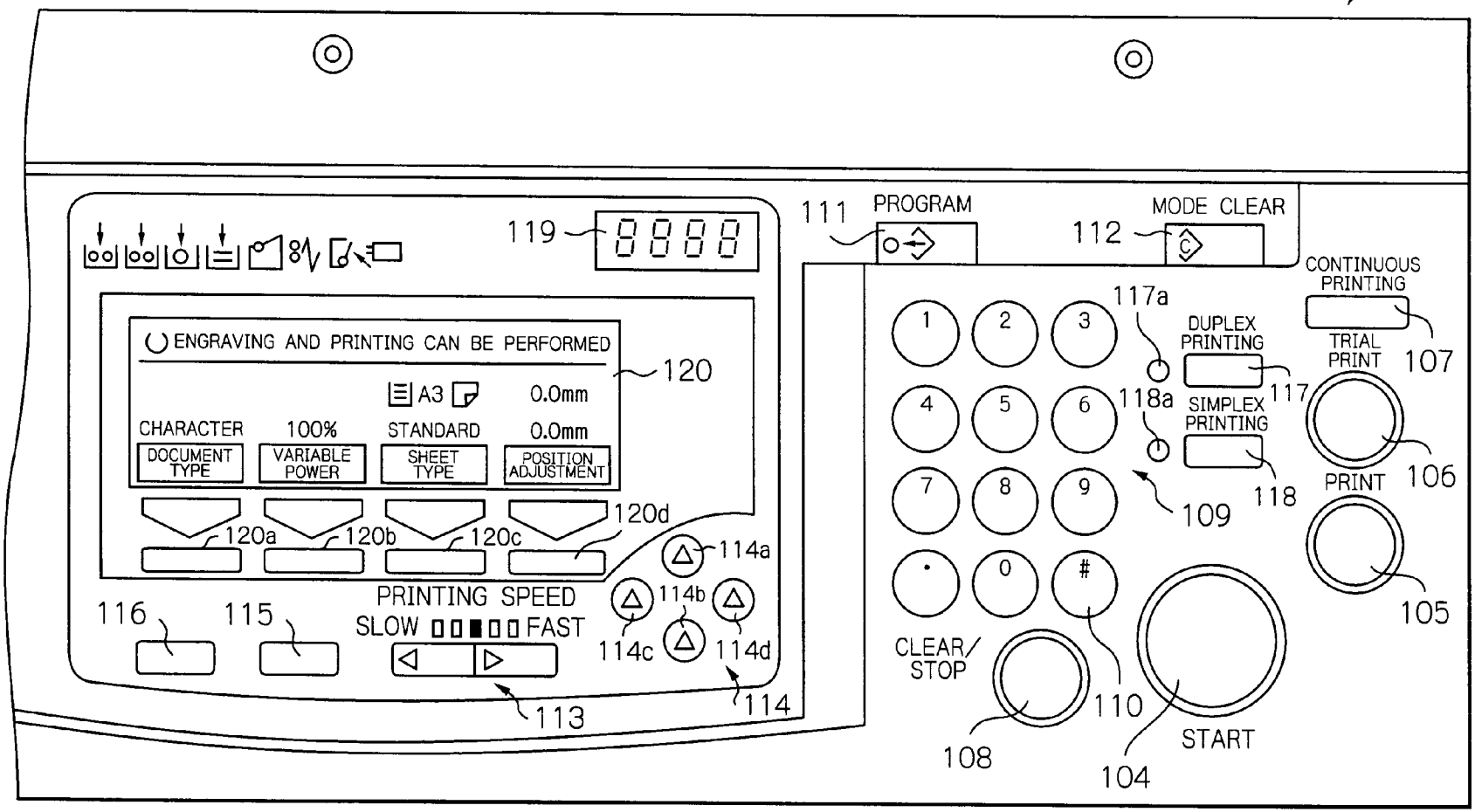
FIG. 8 is a view showing the schematic configuration of an operation panel of the duplex printing apparatus.

FIG. 8 shows an operation panel of the duplex printing apparatus 1. As shown, the operation panel 103 provided on the top front part of the apparatus main body 11 has an engraving start key 104, a print start key 105, a trial print key 106, a continuous key 107, a clear/stop key 108, numeral keys 109, an enter key 110, a program key 111, a mode clear key 112, printing speed setting keys 113, four direction keys 114, a sheet size setting key 115, a sheet thickness setting key 116, a duplex print key 117, a simplex print key 118, a display device 119 constituted by a seven segment LED, a display device 120 constituted by an LCD, and the like.

The detailed functions/configurations of these various keys and display devices 119 and 120 are the same as those described in, for example, the paragraphs "0072" through "0076" of Japanese Unexamined Patent Application Publication No. 2004-26373, thus the explanations thereof are omitted.

When a simplex printing mode for printing only on one side of the sheet P is set, the printing speed is normally set to the third speed (90 rpm: the speed indicated by a blackened part in a printing speed display section shown in FIG. 8), except for the versioning operation that is performed at extremely low speed (approximately 15 through 20 rpm), when the printing speed setting keys 113 are not pressed. Thus control of the slow-up operation where the printing speed reaches the set speed is performed such that the speed is increased by one speed level every time when a single sheet is printed.

However, when a duplex printing mode is set as in the following example, the slow-up operation is not considered until set speed is obtained.

FIG. 9 shows a block diagram of the control means used in the duplex printing apparatus 1. As shown, the control means 129 is constituted by a microcomputer having therein a CPU 130, ROM 131 and RAM 132, and this microcomputer is provided in the apparatus main body 11.

On the basis of various signals from the operation panel 103, detection signals from various sensors provided in the apparatus main body 11, and an operation program called from the ROM 131, the CPU 130 controls the operations of the drive means provided respectively in the printing unit 2, engraving unit 3, sheet feeding unit 4, plate discharge unit 5, sheet discharge unit 6 and image reading unit 7, the drive means of the press roller attaching/detaching mechanism 55 provided in the printing unit 2 (stepping motor 52, print pressure solenoid 181), the solenoid 33 provided in the sheet re-feeding means 9, the suction fan 39, the conveyance unit drive motor 122, the solenoid 123 activating the switching member 10, and controls the operation of the entire duplex printing apparatus 1.

The ROM 131 stores the operation program of the entire duplex printing apparatus 1, and this operation program is called accordingly by the CPU 130. The RAM 132 has a function of temporarily storing a computation result of the CPU 130, and a function of storing data signals and ON/OFF signals that are set and inputted from the various keys and various sensors on the operation panel 103, according to need. Furthermore, the control means 129 determines the position of the plate cylinder 12 on the basis of a home position signal sent from the home position sensor 134 and a signal sent from an encoder, not shown, that is provided in the plate cylinder drive means 121.

On the basis of the above configurations, the operation of the duplex printing apparatus 1 without the sheet receiving board 40 is described hereinafter.

A user stacks the sheets P used for printing on the sheet feeding board 67, opens the pressure plate 94 to place an original document to be printed, on the contact glass 93, and then closes the pressure plate 94. Then, after setting the engraving conditions by means of the various keys on the operation panel 103, the user presses either one of the duplex print key 117 and the simplex print key 118 to set one of the printing modes, and presses the engraving start key 104. First, the situation in which the user presses the simplex print key 118 to perform simplex printing is the same as the situation described in the paragraphs "0080" through "0094" of Japanese Unexamined Patent Application Publication No. 2004-26373, thus the explanations thereof are omitted.

Figure 18:
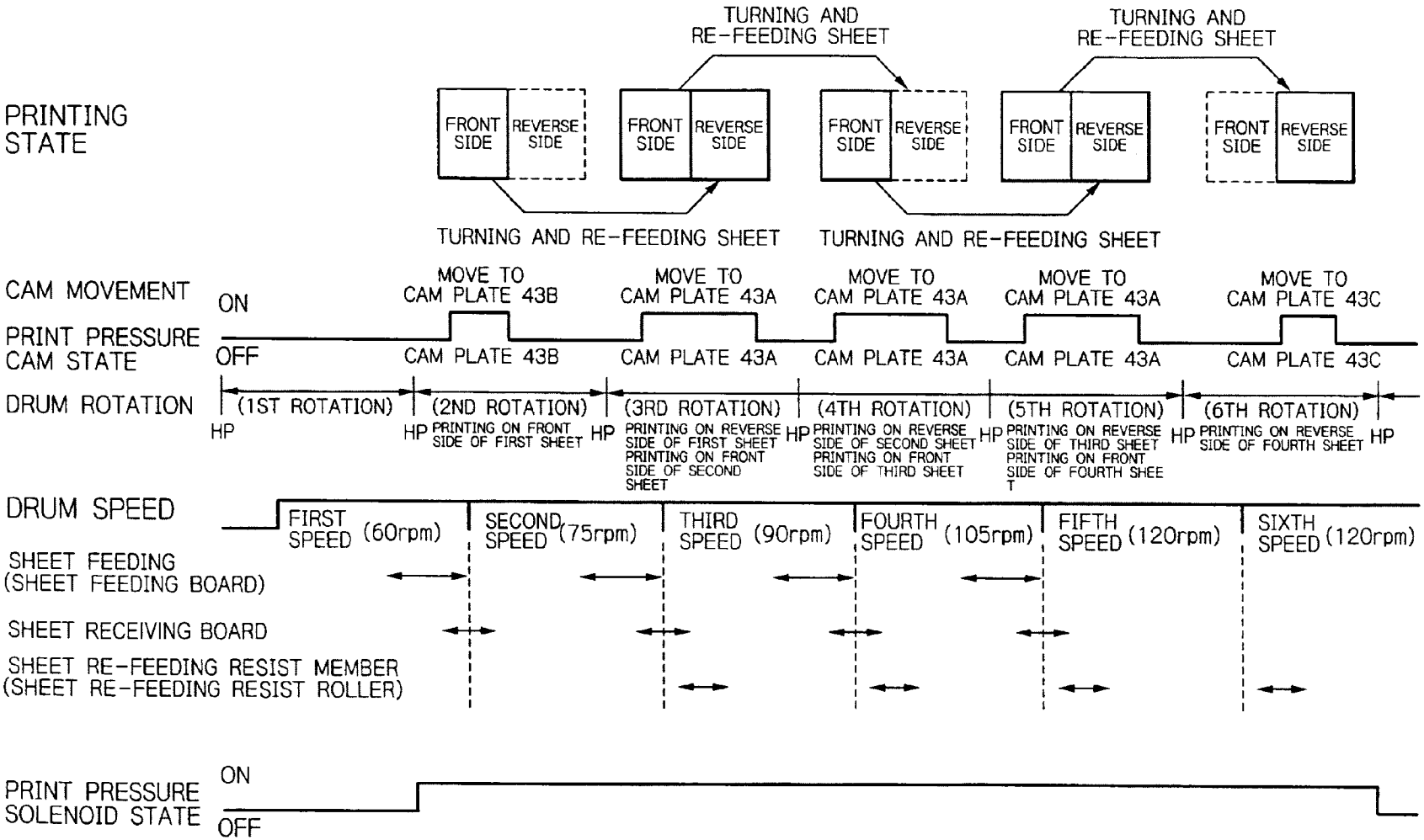
FIG. 18 is a view including a timing chart for explaining a slow-up operation in duplex printing in the first example of the present invention.

Next, FIG. 18 is partially used to describe the case in which the duplex print key 117 is pressed to perform duplex printing. FIG. 18 includes the content related to the specific control of printing speed according to the following embodiment, thus application of the drum speed (rotation speed of the plate cylinder=printing speed) and the sheet receiving board is excluded.

When the user presses the engraving start key 104 after setting a normal sheet or thin sheet P on the sheet feeding board 67 and confirming from the illumination of an LED 117*a* that the duplex printing mode is set, a sheet size detection signal and an original document size detection signal are sent from the sensors 73, 102 respectively to the control means 129 as in the case where simplex printing is performed, and the control means 129 compares these input signals. In this example, since the maximum sheet size printable by the plate cylinder 12 is A3, the maximum sheet size applicable at the time of duplex printing is A4 landscape. If the size of the original document and the sheet size are the same, as a result of comparison between these sizes, an image reading operation is performed immediately, but if the both sizes are different, the control means 129 displays an alarm message on the display device 120 to alert the user.

When the engraving start key 104 is pressed, the image reading unit 7 reads the first image of the original document as in the case of performing simplex printing. The read image of the original document is stored as a first image data signal in the image memory 135. Once the reading operation of reading the first original document is completed and the image data signal is stored in the image memory 135, the control means 129 displays a message, such as "please set the second original document," on the display device 120. The user opens the pressure plate 94 to remove the first original document from the contact glass 93 in accordance with this displayed message, places the second original document, and closes the pressure plate 94. When a sensor, not shown, detects that the pressure plate 94 is closed, and another sensor, not shown, detects that the original document is placed on the contact glass 93, the reading operation is performed on the second original document, as with the first original document. The image of the read original document is stored as a second image data signal in the image memory 135.

In the present embodiment, the operation of reading the original document when the simplex printing mode is set (also called "in the simplex printing mode" hereinafter) or when the duplex printing mode is set (also called "in the duplex printing mode" hereinafter) is performed by the user opening/closing the pressure plate 94 and setting, on the contact glass 93, the original document to be read. Alternatively, an ADF may be used to automatically convey the original document to the contact glass 93, or image data may be downloaded from an unshown external device (e.g., a computer). In addition, in the duplex printing mode, a single original document may be reversed and then conveyed to produce two pages of image data from the front and reverse sides of the original document.

Figure 6:
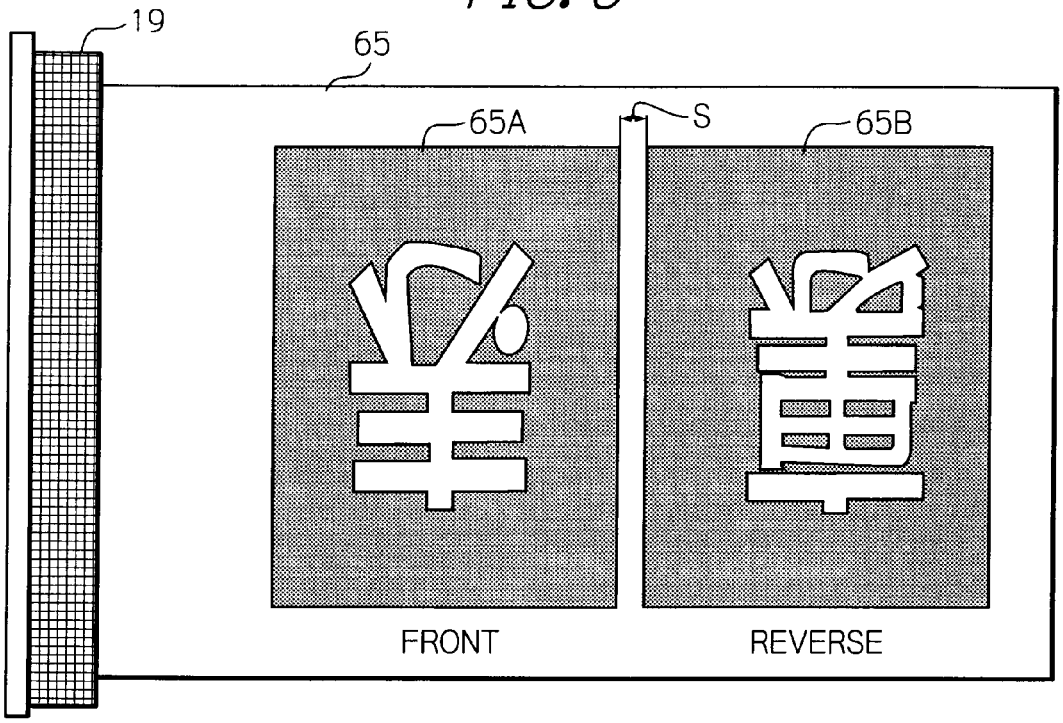
FIG. 6 is a view showing a duplex master used in the duplex printing apparatus.
Figure 7:
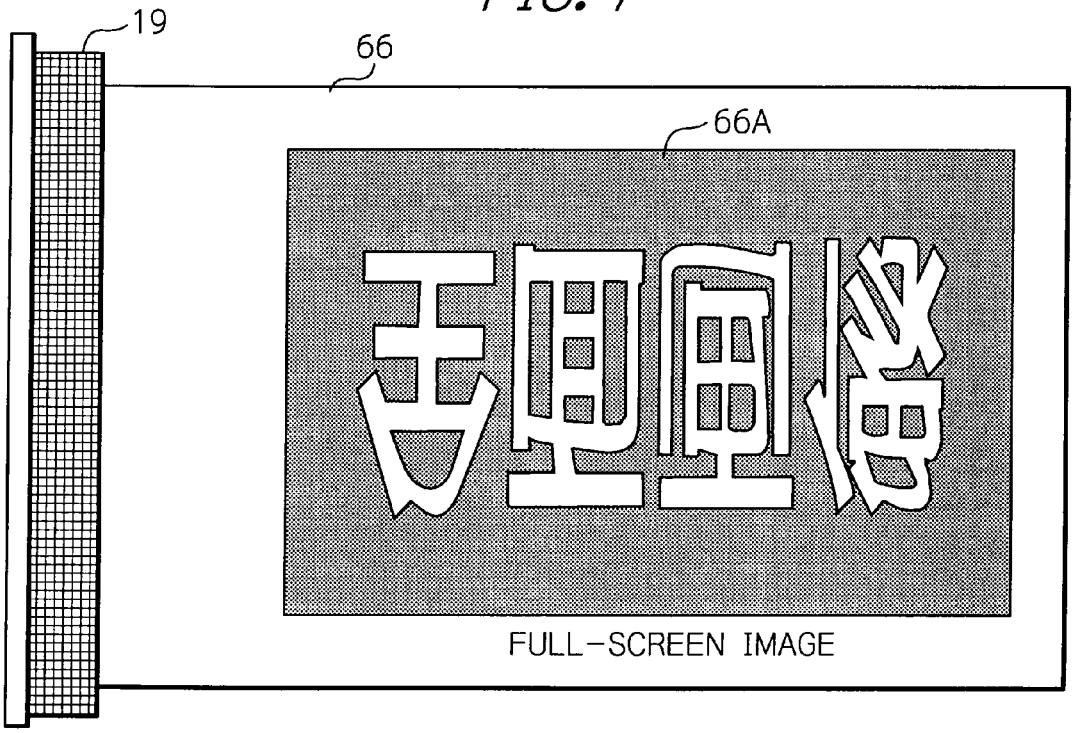
FIG. 7 is a view showing a simplex master used in the duplex printing apparatus.

In parallel with the image reading operation performed by the image reading unit 7, the plate discharge unit 5 performs a plate discharging operation as in the simplex printing mode. The plate cylinder 12, from the outer peripheral surface of which a used master 64*c* is released, stops at a plate feed standby position, and the clamper 19*b* is opened by unshown opening/closing means. In parallel with this plate discharging operation, an engraving operation is performed by the engraving unit 3. The engraving operation is performed in the same sequence as in the simplex printing mode except that the first engraved image 65A and the second engraved image 65B are formed on a surface of a thermoplastic resin film of the master 64. At this moment, the images 65A and 65B are engraved such that a predetermined blank section S is provided between the first engraved image 65A and the second engraved image 65B as shown in FIG. 6. This predetermined blank section S is placed in a position corresponding to the intermediate region shown in FIG. 1, when the duplex master 65 is wrapped around the outer peripheral surface of the plate cylinder 12.

The duplex master 65 on which the engraved images 65A and 65B are formed is stored in the master stocking section 61. When the duplex printing apparatus 1 enters the plate feed standby state after the completion of the plate discharging operation, the duplex master 65 is conveyed toward a space between the stage section 19*a* and the opened clamper 19*b* by the activation of the turn roller pair 63. Subsequently, the plate cylinder 12 is intermittently rotated as in the simplex printing mode, so that the duplex master 65 is wrapped around the plate cylinder 12. After the two pages of image data are all delivered from the image memory 135, the cutting means 60 is activated to cut off the duplex master 65. The cut duplex master 65 is then pulled out of the engraving unit 3 by the rotation of the plate cylinder 12, and then the plate cylinder 12 is stopped at the home position, completing the engraving operation and plate feeding operation.

The plate feeding operation is followed by the versioning operation and trial printing. The versioning operation is the same as the one described in the paragraphs "0101" through "0114" of Japanese Unexamined Patent Application Publication No. 2004-26373, and the trial printing operation is the same as the one described in the paragraphs "0115" through "0120" of the same publication, thus the explanations thereof are omitted.

The position, density or the like of an image is confirmed through the trial printing. When the print start key 105 is pressed after the number of prints is input by means of the numeral keys 109, a new printing operation is executed. The present embodiment describes the case in which N is input as the number of prints.

Once the print start key 105 is pressed, the plate cylinder 12 stops at the home position as in the versioning and trail printing operations, and thereupon the stepping motor 52 is activated to rotate the stepped cam 49 and activate the print pressure solenoid 181, whereby the cam section 49*a* is brought into contact with the cam follower 48*c*. As a result, the moving arm 48 is swung around the spindle 48*a* to move the cam shaft 44 to the position where the cam plate 43B can contact the cam follower 41. Thereafter, the activation of the print pressure solenoid 181 is canceled.

Subsequently, the sheet feeding roller 68, separating roller 69, driving rollers 36 and 87 and suction fans 39 and 90 are driven while the plate cylinder 12 is rotary driven in the clockwise direction as viewed in FIG. 1 at the set printing speed (called "set speed" hereinafter). Moreover, the first sheet P is pulled out of the sheet feeding board 67 such that the leading edge of this sheet is caused to abut on the nip section between the pair of resist rollers 71 (also simply called "resist roller pair 71" hereinafter) and is held temporarily. Then, after the clamper 19*b* passes through the position corresponding to the switching member 10, the solenoid 123 is activated to move the switching member 10 to the second displacement position. Thereafter, the driving roller 71*a* is rotary driven at a predetermined timing at which the leading edge of the image area of the first engraved image 65A of the duplex master 65 in the plate cylinder rotation direction reaches the position corresponding to the press roller 13, the duplex master 65 being wrapped around the plate cylinder 12, whereby the first pulled out sheet P is conveyed toward the position between the plate cylinder 12 and the press roller 13.

At the above predetermined timing, the cam plate 43B, which has been moved to the position where it can contact the cam follower 41, detaches the projecting section thereof from the cam follower 41, whereby the peripheral surface of the press roller 13 is pressed against the outer peripheral surface of the plate cylinder 12 by the biasing force of the print pressure spring 42. As a result, the press roller 13 presses the delivered first sheet P against the first engraved image 65A of the duple master 65, so that an image corresponding to the first engraved image 65A is printed on the surface of the sheet, whereby a first surface-printed sheet PA is obtained.

The first surface-printed sheet PA is guided by the switching member 10 occupying the second displacement position toward the sheet re-feeding means 9 while being gradually peeled off from the duplex master 65 on the outer peripheral surface of the plate cylinder by the leading edge of the switching member 10. The surface-printed sheet PA guided downward by the switching member 10 abuts against the end fence 8*a* at one end via the path between the guide plates 27 and 56, and is then placed on the auxiliary tray 8. The endless belt 38 conveys, while holding, the surface-printed sheet PA conveyed onto the auxiliary tray 8, in a direction shown by the arrow in FIG. 1, by means of the suction force of the suction fan 39, and the other end of this sheet (the rear end during printing of the first image 65A) is caused to abut against the sheet re-feeding positioning member 24. At this moment, the sensor 8*c* detects the other end of the surface-printed sheet PA, and the detection signal is output from the sensor 8*c* toward the control means 129, whereby a command is sent from the control means 129 to stop the operation of the driving roller 36 and of the suction fan 39.

Even when a first surface-printed sheet PA is being guided to the auxiliary tray 8, the plate cylinder 12 is continuously rotated. The press roller 13, after completing its contact with the front surface region of the plate cylinder 12, occupies the release position by causing the projecting section of the cam plate 43B to abut against the cam follower 41. This operation of the cam plate 43B prevents the reverse surface region of the plate cylinder 12 and the press roller 13 from contacting each other without having the sheet P, whereby the transfer of the ink to the peripheral surface of the press roller 13 can be avoided. At this moment, the print pressure solenoid 181 is activated to hold the press roller 13 at the release position. Thereafter, the stepping motor 52 is activated to rotate the stepped cam 49, and the cam section 49*b* is caused to abut against the cam follower 48*c*. Accordingly, the moving arm 48 is swung around the spindle 48*a*, and the cam shaft 44 is moved to the position where the cam plate 43A can contact the cam follower 41.

At substantially the same time as the above operation, the sheet feeding roller 68 and separating roller 69 are driven to pull out the second sheet P from the sheet feeding board 67 and cause the leading edge of this sheet to abut against the resist roller pair 71. The driving roller 71*a* is rotary driven at the same predetermined timing as the timing mentioned above, and the pulled out second sheet P is fed toward the position between the plate cylinder 12 and the press roller 13.

On the other hand, in the press roller attaching/detaching mechanism 55, when the cam shaft 44 is rotated to a position where the projecting section of the cam plate 43A can contact the cam follower 41, the activation of the print pressure solenoid 181 is canceled. At this moment, the plate cylinder 12, rotating in synchronization with the cam shaft 44, occupies the position where a non-porous section faces the press roller 13, the non-porous section being a section other than the front surface region, reverse surface region and intermediate region. Furthermore, the solenoid 123 is activated between the time when the front surface region of the plate cylinder 12 passes through the section facing the press roller 13 and the time when the clamper 19*b* faces the switching member 10 again, whereby the switching member 10 is displaced from the second displacement position to the first displacement position.

Furthermore, the second sheet P is fed from the sheet feeding unit 4 at substantially the same time as the above operation. After the second sheet P is temporarily stopped at the resist roller pair 71, the second sheet P is fed toward the printing unit 2 at the same timing as the first sheet P. After the switching member 10 is positioned to the first displacement position for avoiding collision with the clamper 19*b*, the switching member 10 is again placed in the second displacement position after the passage of the clamper 19*b*.

The fed second sheet P is pressed against the first engraved image 65A of the duplex master 65 by the press roller 13, and an image corresponding to the first engraved image 65A is printed on the surface of this sheet to obtain a second surface-printed sheet PA. Subsequently, the switching member 10 occupying the second displacement position peels, guides, and conveys this surface-printed sheet PA to the auxiliary tray 8. At this moment, the solenoid 33 is activated at the same timing as the trial printing, and the swing arm 32 is swung around the spindle 32*a* in the clockwise direction as viewed in FIG. 2. Accordingly, the sheet re-feeding resist roller 23 is swung from the release position to the pressing position. The first surface-printed sheet PA that is held in a state in which the other end thereof contacts the sheet re-feeding positioning member 24 is caused to contact the peripheral surface of the press roller 13 rotating in the same circumferential speed as the plate cylinder 12, whereby the first surface-printed sheet PA is turned and re-fed/conveyed to the printing unit 2. After the rear end of the second surface-printed sheet PA completely passes through the section of abutment between the plate cylinder 12 and the press roller 13, the first surface-printed sheet PA passes through the position where the intermediate region of the plate cylinder 12 faces the press roller 13, is further sent to the section of abutment between the plate cylinder 12 and the press roller 13 at the timing at which the reverse surface region faces the press roller 13, and is then pressed against the second engraved image 65B of the duplex master 65 by the press roller 13, whereby an image corresponding to the second engraved image 65B is printed on the reverse side of the first surface-printed sheet PA to obtain a printed sheet PB.

During the above operation, the solenoid 123 is activated before the position where the intermediate region of the plate cylinder 12 faces the press roller 13 is occupied. Then the switching member 10 is displaced from the second displacement position to the first displacement position. Accordingly, the rear end (other end) of the second surface-printed sheet PA guided by the switching member 10 passes through a small space between a lower surface 10*a* of the switching member 10 and the peripheral surface of the press roller 13, and is then guided to the auxiliary tray 8. The leading end (one end) of the first printed sheet PB that has been conveyed subsequently is guided to the sheet discharging conveyance unit 85 along an upper surface 10*b* of the switching member 10. After the first printed sheet PB is peeled off from the duplex master 65 by the peeling pawl 84, the first printed sheet PB is conveyed by the sheet discharging conveyance unit 85 and then discharged to the catch tray 86.

Subsequently, a third sheet P is delivered from the sheet feeding unit 4. The third sheet P is temporarily held at the resist roller pair 71, and thereafter delivered to the printing unit 2 at the same timing as the first and second sheets P. The switching member 10 is positioned at the first displaced position for avoiding collision with the clamper 19*b*, and then positioned at the second displacement position again after passage of the clamper 19*b*. An image corresponding to the first engraved image 65A is printed on the front surface of the delivered third sheet P to obtain a surface-printed sheet PA. Thereafter, the surface-printed sheet PA is guided by the switching member 10 to the auxiliary tray 8. Then, the solenoid 33 is activated at a predetermined timing, and the second surface-printed sheet PA held on the auxiliary tray 8 is conveyed to the printing unit 2.

The second surface-printed sheet PA is sent to the section of abutment between the plate cylinder 12 and the press roller 13 at the same timing as the first surface-printed sheet PA. Then an image corresponding to the second engraved image 65B is printed on the reverse side of the second surface-printed sheet PA to obtain a second printed sheet PB. The switching member 10 is displaced from the second displacement position to the first displacement position at the same timing as above, and the rear end (other end) of a third surface-printed sheet PA is guided to the auxiliary tray 8 via the small space between the lower surface 10*a* of the switching member 10 and the peripheral surface of the press roller 13. Subsequently, the leading end (one end) of the second printed sheet PB conveyed from the auxiliary tray 8 is guided to the sheet discharging conveyance unit 85 along the upper surface 10*b* of the switching member 10. After the second printed sheet PB is peeled off from the duplex master 65 by the peeling pawl 84, the second printed sheet PB is conveyed by the sheet discharging conveyance unit 85 and then discharged to the catch tray 86.

Hereinafter, the same printing operation as above is repeated until $(N-1)^{th}$ print is obtained. The $N^{th}$ sheet P is fed from the sheet feeding section 4, formed with an image corresponding to the first engraved image on its front side, and then guided to the auxiliary tray 8 as an $N^{th}$ surface-printed sheet PA. Subsequently, a $(N-1)^{th}$ surface-printed sheet PA is formed with an image corresponding to the second engraved image 65B on its reverse side, and then discharged to the catch tray 86 as a $(N-1)^{th}$ printed sheet PB. Thereafter, the print pressure solenoid 181 is activated to hold the press roller 13 at the release position, and the cam shaft 44 is shifted to the position where the cam plate 43C can contact the cam follower 41. Thereafter, the activation of the print pressure solenoid 181 is canceled. At this moment, the switching member 10 remains in the first displacement position.

At a first timing earlier than the time when the leading edge of the image area of the second engraved image 65B of duplex master 65 in the plate cylinder rotation direction arrives at the position corresponding to the press roller 13, the projecting section of the cam plate 43C that is moved to the position where it can contact the cam follower 41 is released from the cam follower 41, whereby the peripheral surface of the press roller 13 is pressed against the outer peripheral surface of the plate cylinder 12 by the biasing force of the print pressure spring 42. Thereafter, at a second timing slightly earlier than the time when the leading edge of the image area of the second engraved image 65B of the duplex master 65 in the plate cylinder rotation direction arrives at the position corresponding to the press roller 13, the solenoid 33 is activated to swing the moving arm 32 in the clockwise direction, as viewed in FIG. 2, around the spindle 32*a*. Consequently, the sheet re-feeding resist roller 23 is shifted from the release position to the pressing position, so that the stopped $N^{th}$ surface-printed sheet PA, the other end of which abuts against the sheet re-feeding positioning member 24, is caused to abut against the peripheral surface of the press roller 13 rotating at substantially the same circumferential speed as the plate cylinder 12, whereby the $N^{th}$ surface-printed sheet PA is re-fed to the printing unit 2 while being turned.

The $N^{th}$ surface-printed sheet PA is sent to the section of abutment between the plate cylinder 12 and the press roller 13 at the same timing as the first surface-printed sheet PA, so that an image corresponding to the second engraved image 65B is printed on the reverse side of this sheet PA to obtain an $N^{th}$ printed sheet PB. The $N^{th}$ printed sheet PB is then guided by the upper surface 10*b* of the switching member 10 to the sheet discharging conveyance unit 85, peeled off from the duplex master 65 by the peeling pawl 84, and then conveyed by the sheet discharging conveyance unit 85 to be discharged to the catch tray 86. Subsequently, upon the completion of contact between the press roller 13 and the reverse surface region of the plate cylinder 12, the projecting section of the cam plate 43C contacts the cam follower 41, whereby the press roller 13 occupies the release position. This action of the cam plate 43C prevents the front surface region of the plate cylinder 12 and press roller 13 from contacting each other without having sheet P, whereby the transfer of the ink to the peripheral surface of the press roller 13 can be avoided. At this moment, the print pressure solenoid 181 is activated to hold the press roller 13 at the release position, and then the plate cylinder 12 stops at the home position. The duplex printing apparatus 1 thus completes the printing operation and again enters the print standby state.

This duplex printing apparatus 1 achieve the advantages/effects same as those described in, for example, the paragraphs "0131" through "0133" of Japanese Unexamined Patent Application Publication No. 2004-26373.

However, the duplex printing apparatus 1 has the following defects in continuous printing. These defects are described below.

In the abovementioned printing operation, when the second sheet P passes through the nip between the plate cylinder 12 and the press roller 13 and is then sent to the auxiliary tray 8 as the second surface-printed sheet PA2, the first surface-printed sheet PA1 is sent from the auxiliary tray 8 toward the nip between the plate cylinder 12 and the press roller 13. At this moment, as shown in FIG. 10, one end of the surface-printed sheet PA2 contacts one end of the surface-printed sheet PA1, whereby stain is generated by friction between the one end of the surface-printed sheet PA2 and the reverse side, and stain is generated by friction on the one end of the surface-printed sheet PA1 as well.

Also, the one end of the surface-printed sheet PA2 has to be conveyed to the left side as viewed in the figure. However, there is a defect in which the one end contacts the one end of the surface-printed sheet PA1 conveyed to the right side in the figure, and the adhesive strength of the ink on the surface-printed sheet PA1 and conveyance force for conveying the sheet to the right side of the figure negate the conveyance force for conveying the sheet P to the left side of the figure, whereby the surface-printed sheet PA2 stops, causing a conveyance jam.

Figure 10:
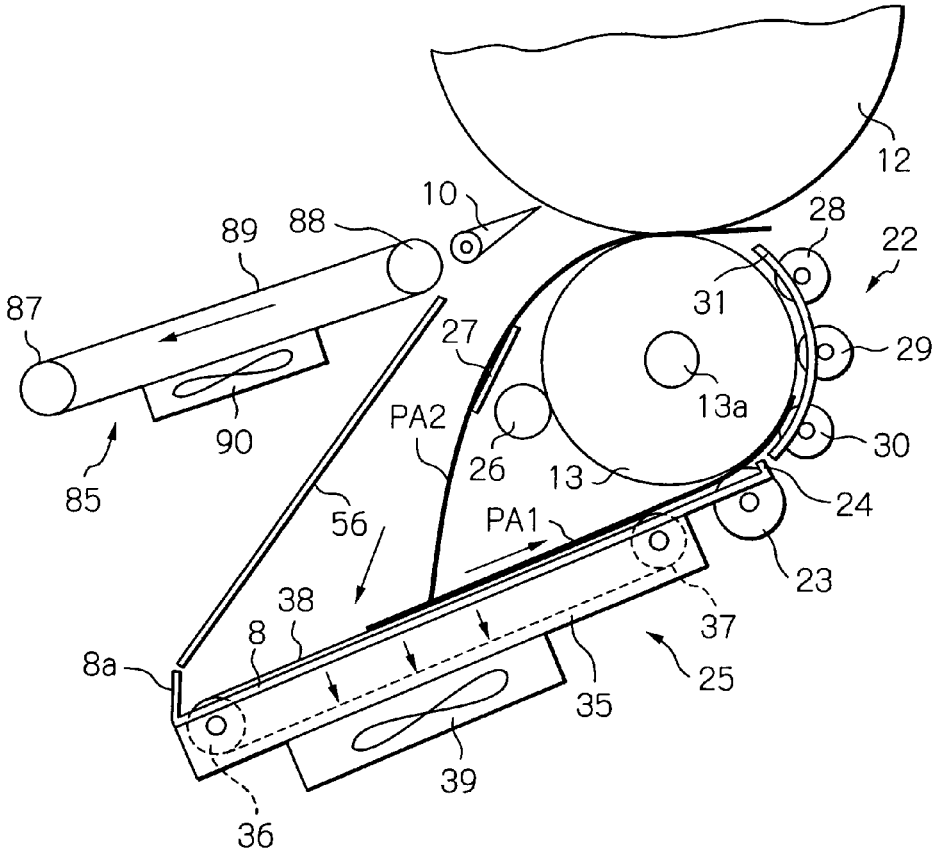
FIGS. 10 and 11 are front views each showing the schematic configuration of the substantial part of a printing unit for explaining problems in continuous printing performed by the duplex printing apparatus.
Figure 11:
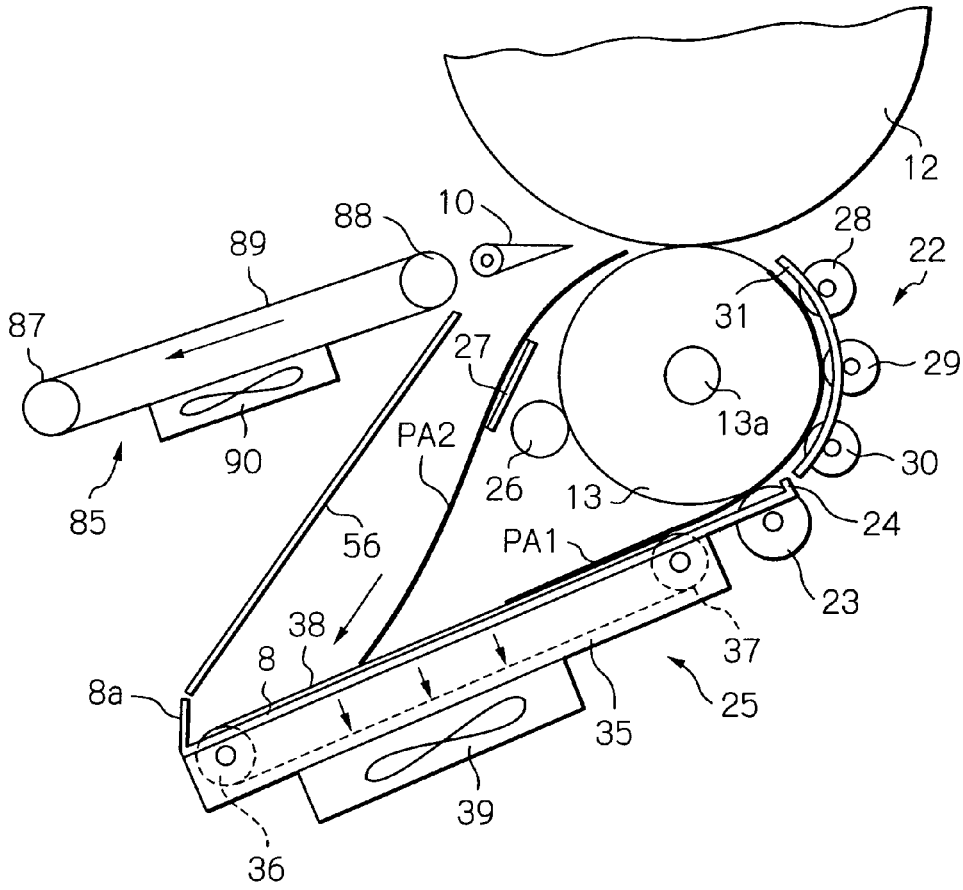
Figure 12:
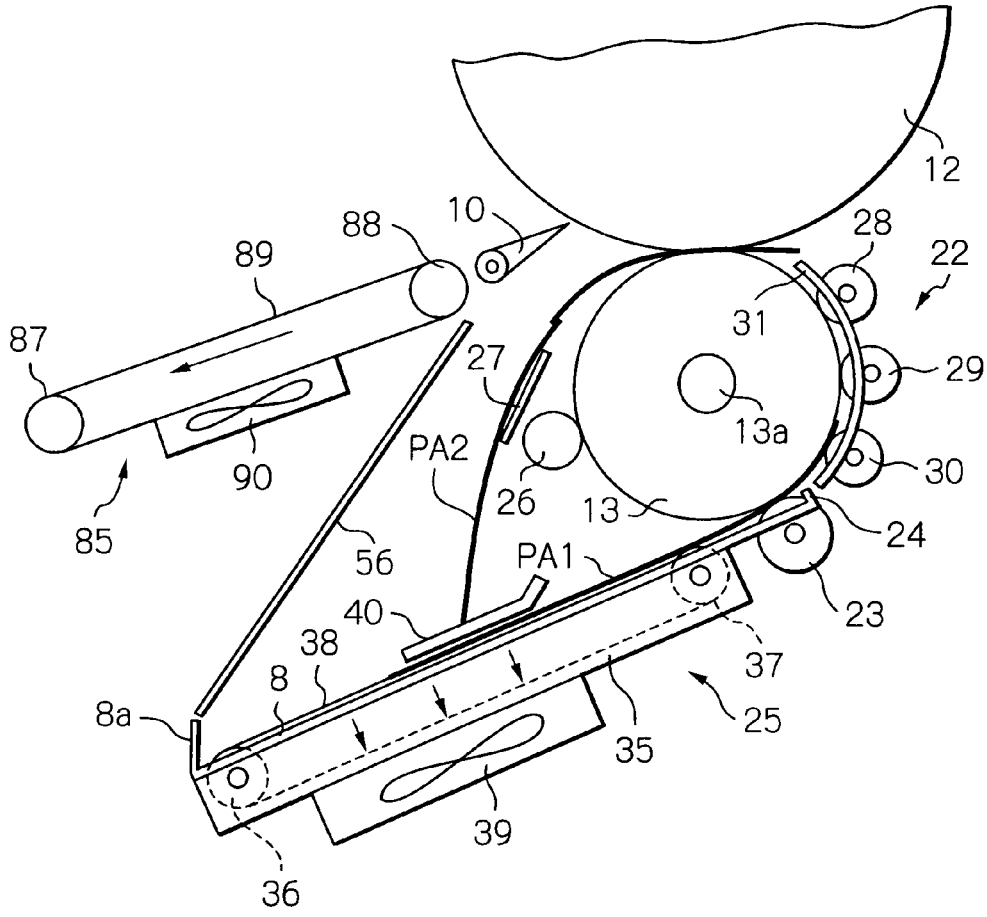
FIGS. 12 and 13 are front views each showing the schematic configuration of the substantial part of the printing unit for explaining continuous printing operation performed by the duplex printing apparatus.

Furthermore, FIG. 11 shows that the plate cylinder 12 is slightly rotated from the state shown in FIG. 10. However, there is a defect in which, after the surface-printed sheet PA1 is conveyed, the surface-printed sheet PA2 is dropped on the auxiliary tray 8 having no sheets, and the drawn by the suction force of the activated suction fan 39 to the auxiliary tray 8, and the conveyance force for conveying the sheet to the left side of the figure is negated by the frictional force of the endless belt 38, whereby good conveyance of the surface-printed sheet PA2 is interrupted, causing a conveyance jam.

In order to eliminate the defects described above, in the present embodiment the sheet receiving board 40 shown in FIG. 1 is provided on the auxiliary tray 8. Hereinafter, this sheet receiving board 40 is described. The sheet receiving board 40 functions as sheet catching means for catching the leading edge of the surface-printed sheet PA2 guided by the switching member 10 to the auxiliary tray 8.

The sheet receiving board 40 is in the form of a cross-sectionally inverted "C" and has protrusions 40*a*, 40*b*, 40*c* and 40*d* on both sides thereof as shown in FIG. 3. Each of the protrusions 40*a*, 40*b*, 40*c* and 40*d* is fitted to an unshown long hole formed on each side of the conveyance unit main body 35. Also, a cutout section 40*e* serving as a fitting section to which each end fence 8*a* can be fitted is formed on one end of the sheet receiving board 40. A rack section 40*f* extended to the other end is formed on each side of the sheet receiving board 40. The sheet receiving board 40 is disposed on a position that is apart from each endless belt 38, and the space between a lower surface of the position and each endless belt 38 is set to be a predetermined space so that the surface-printed sheet PA can be conveyed well on each endless belt 38.

A stepping motor 138 having two pinions 139 on an output shaft 138*a* is attached to the outside of one of the side plates of the conveyance unit main body 35. A leading end of the output shaft 138*a* is rotatably supported on the other side plate of the conveyance unit main body 35, and each of the pinions 139 is disposed on the position in the vicinity of each side plate of the conveyance unit main body 35, the position being a position where each pinion is engaged with each rack section 40*f*.

A home position sensor 140 for detecting the home position of the sheet receiving board 40 is disposed in the vicinity of the stepping motor 138. The home position 140 is disposed on the position where the projecting section of the protrusion 40*d* can be detected, and a signal sent from the home position sensor 140 is output to the control means 129.

Figure 13:
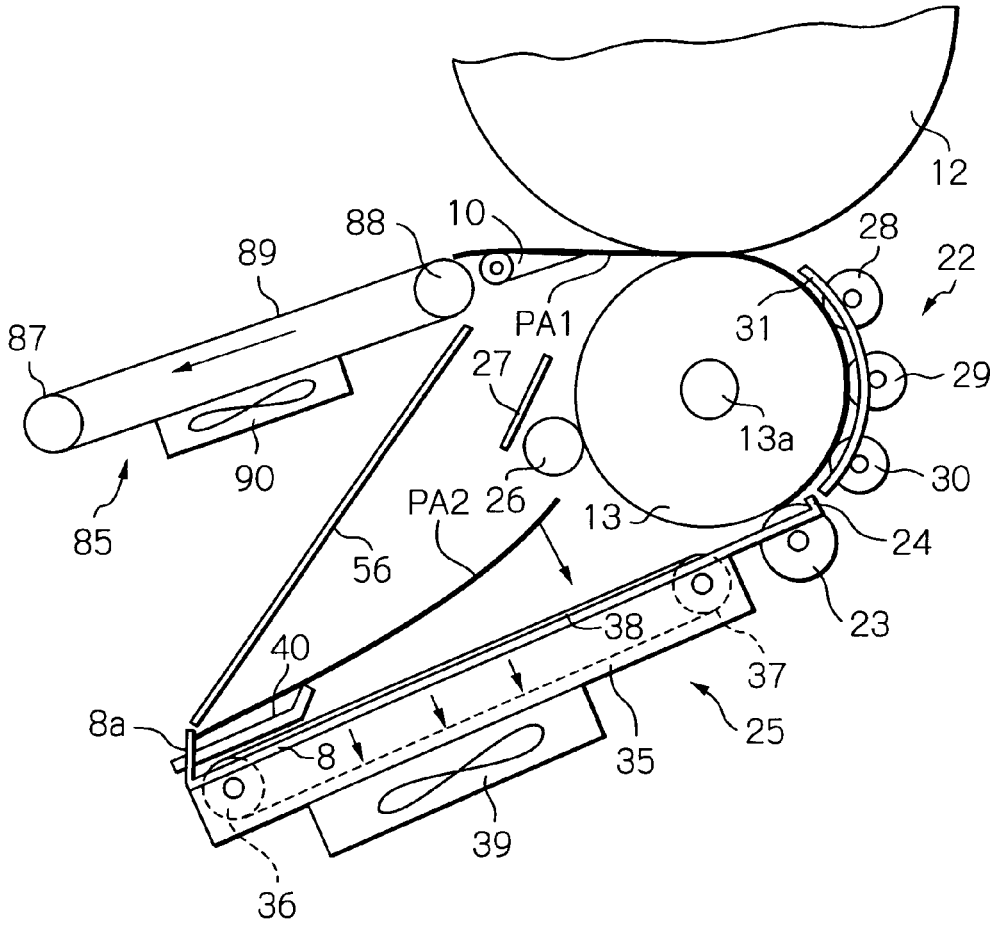

In the above configuration, the sheet receiving board 40 is selectively reciprocated between a first position and a second position by the stepping motor 138. The first position is a home position shown in FIG. 12 for catching one end of the surface-printed sheet PA2 conveyed from the printing unit 2 proximate to the press roller 13, while the second position shown in FIG. 13 is a position where the other end of the surface-printed sheet PA2, which is farthest from the press roller 13 and placed on the upper surface thereof, is brought into contact with each endless belt 38.

As described above, the stepping motor 138, each pinion 139 and each rack section 40*f* function as moving means for reciprocating the sheet receiving board 40 between the first position and the second position.

Furthermore, the length of the sheet receiving board 40 in the sheet conveying direction is set to a length in which one end of the surface-printed sheet PA2 is dropped from the sheet receiving board 40, when the sheet receiving board 40 occupies the second position, and the other end of the surface-printed sheet PA2 on the sheet receiving board 40 is dropped from the sheet receiving board 40 onto each endless belt 38 to convey the surface-printed sheet PA2 by using the sheet re-feeding conveyance unit 25, and when the other end of this sheet abuts against the sheet re-feeding positioning member 24.

By means of this operation of the sheet receiving board 40, the surface-printed sheet PA1 and the surface-printed sheet PA2 can be prevented from contacting each other during continuous printing. Moreover, stain can be prevented from occurring by friction between the one end and the reverse side of the surface-printed sheet PA2 and on the one end side of the surface-printed sheet PA1. In addition, a conveyance jam can be prevented from occurring by conveying the surface-printed sheet PA2 in an excellent manner.

The operation of the stepping motor 138 reciprocating the sheet receiving board 40 may be controlled by the control means 129 on the basis of a signal from the sensor 8*c*, and the sheet receiving board 40 may be moved from the second position to the first position when the leading edge of the surface-printed sheet PA1 is detected by the sensor Bc. Accordingly, the surface-printed sheet PA2 can be securely suctioned and conveyed by the sheet re-feeding conveyance unit 25. Furthermore, after the other end of this sheet abuts against the sheet re-feeding positioning member 24 and the one end is dropped from the sheet receiving board 40, the sheet receiving board 40 is moved from the second position to the first position, thus the sheet receiving board 40 and the surface-printed sheet PA2 can be securely prevented from interfering each other, and the occurrence of a sheet conveyance jam can be securely avoided.

In addition, one end of the sheet receiving board 40 has the cutout section 40*e* capable of being fitted to each end fence 8*a*. Therefore, the one end of the surface-printed sheet PA1 can be prevented from entering the section between the end fence 8*a* and the sheet receiving board 40, and thus caused sheet conveyance jam can be prevented from occurring.

Figure 14:
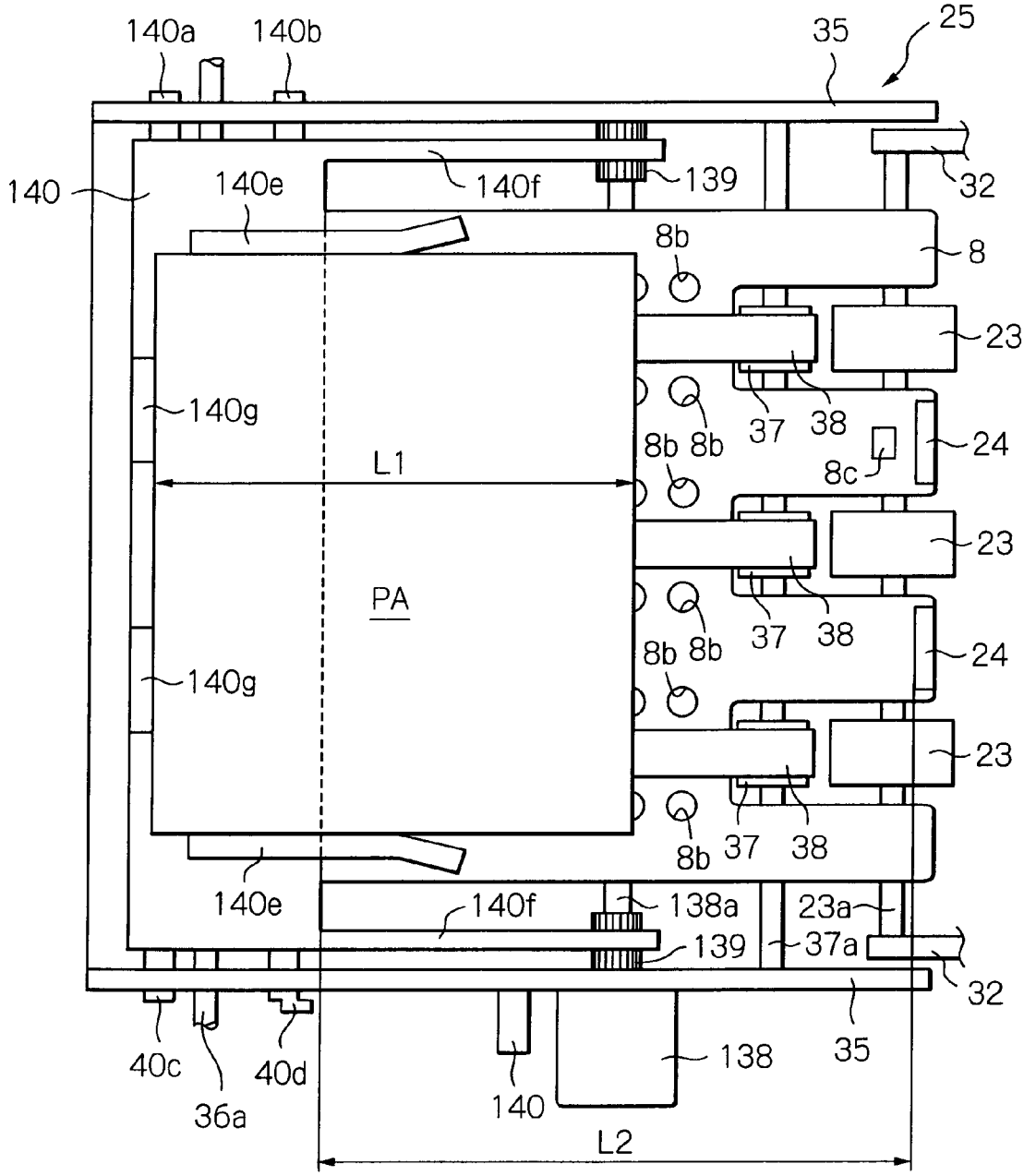
FIG. 14 is a plan view showing the schematic configuration of the sheet receiving board according to the second embodiment of the present invention.
Figure 15:
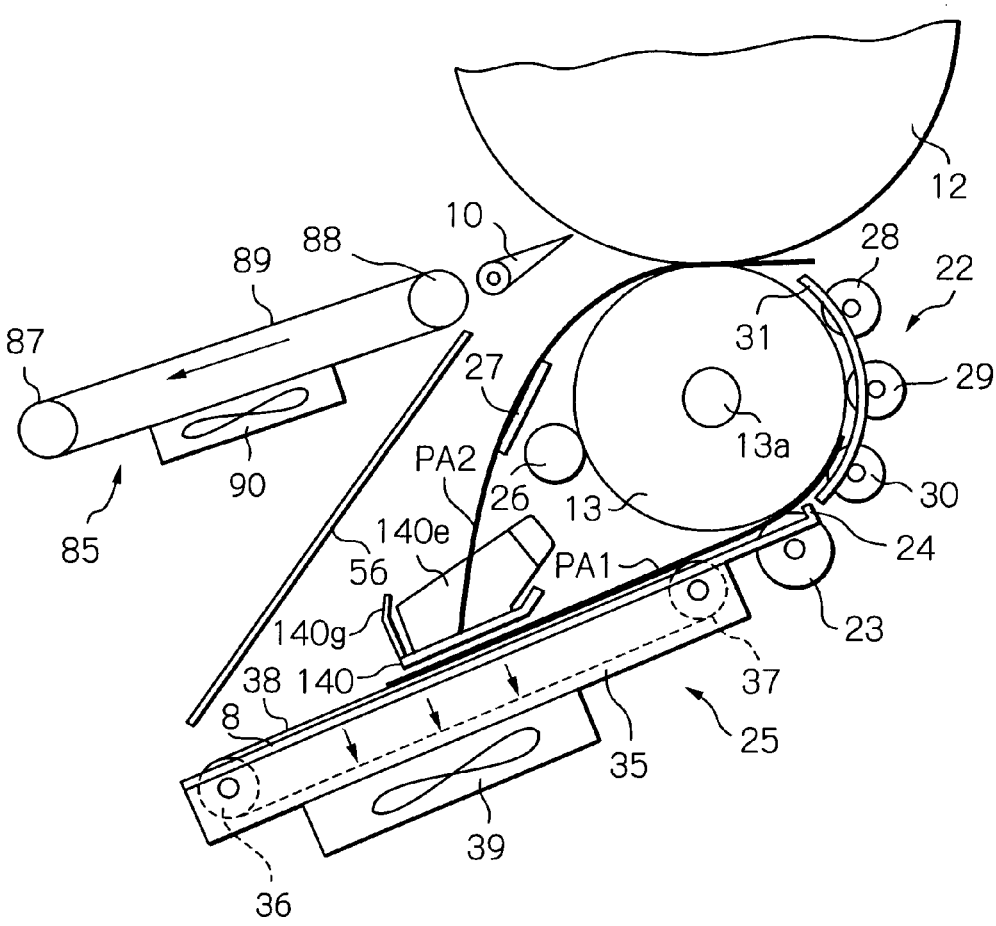
FIG. 15 is a front view showing the schematic configuration of the substantial part of the printing unit for explaining the sheet receiving board.

FIG. 14 and FIG. 15 show a sheet receiving board 140 serving as sheet catching means used in a second embodiment. This sheet receiving board 140 is different from the sheet receiving board 40 described in the first example in that the sheet receiving board 140 does not have a cutout section as a fitting section, that the sheet receiving board 140 has protrusions 140*a* 140*b*, 140*c* and 140*d* same as the protrusions 40*a*, 40*b*, 40*c* and 40*d* and a rack section 140*f* same as the rack section 40*f*, and that the sheet receiving board 140 has a pair of side fences 140*e* and two end fences 140*g*. The other configurations of the sheet receiving board 140 are the same as those of the sheet receiving board 40. It should be noted in this second embodiment that the auxiliary tray 8 does not have the end fences 8*a*.

Also, in this sheet receiving board 140 as well, the length thereof in the sheet conveying direction is set to a length in which the one end of the surface-printed sheet PA is dropped from the sheet receiving board 140, when the sheet receiving board 140 occupies the second position, and the other end of the surface-printed sheet PA on the sheet receiving board 40 is dropped from the sheet receiving board 140 onto each endless belt 38 to convey the surface-printed sheet PA by using the sheet re-feeding conveyance unit 25, and when the other end of this sheet abuts against the sheet re-feeding positioning member 24.

Specifically, in FIG. 14, the abovementioned length is set such that the distance L2 from both ends of the sheet placed on the sheet receiving board 140 occupying the second position to the sheet re-feeding positioning member 24 is greater than the length L1 of the surface-printed sheet PA in the sheet conveying direction. It is appropriated that the difference between L1 and L2 be approximately 10 through 20 mm.

By providing such configuration as described above, the position of the surface-printed sheet PA in its width direction can be determined by each side fence 140*e*, and the position of the same in its conveying direction is determined by the end fence 140*g*, thereby conveying the surface-printed sheet PA. Therefore, skew and displacement of the surface-printed sheet PA that could occur when the sheet is dropped onto the auxiliary tray 8 can be effectively prevented from occurring, and the occurrence of a sheet conveyance jam can be avoided.

Figure 16:
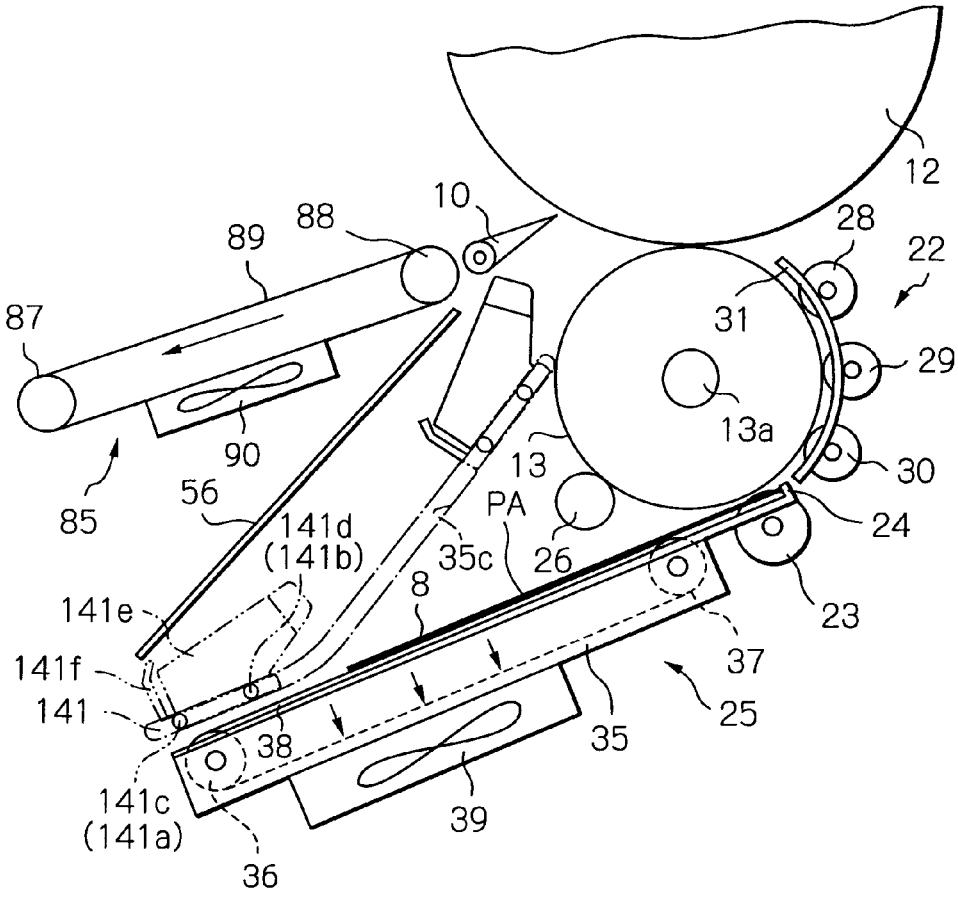
FIG. 16 is a front view showing the schematic configuration of the substantial part of the printing unit for explaining the sheet receiving board according to the third embodiment.

FIG. 16 shows a sheet receiving board 141 serving as sheet catching means used in a third embodiment. This sheet receiving board 141 is different from the sheet receiving board 140 described in the second embodiment in that the sheet receiving board 141 has protrusions 141*a* 141*b*, 141*c* and 141*d* same as the protrusions 140*a*, 140*b*, 140*c* and 140*d*, and that the sheet receiving board 141 has a pair of side fences 141*e* same as the pair of side fences 140*e* and two end fences 141*f* same as the two end fences 140*g*. The other configurations of the sheet receiving board 141 are the same as those of the sheet receiving board 140. It should be noted in the third embodiment that the auxiliary tray 8 does not have the end fences 8*a*, and the drive mechanism of the sheet receiving board 141 is also different. Moreover, the position where the cleaning roller 26 is disposed is also different, and the guide plate 27 is not provided.

Each of the protrusions 140*a*, 140*b*, 140*c* and 140*d* is fitted to a long hole 35*c* formed between both side plates 35*b* (see FIG. 17) of the conveyance unit main body 35. The long hole 35*c* is formed at a tilt so as to be substantially the same as a path for dropping the surface-printed sheet PA from the printing unit 2 onto the auxiliary tray 8.

Figure 17:
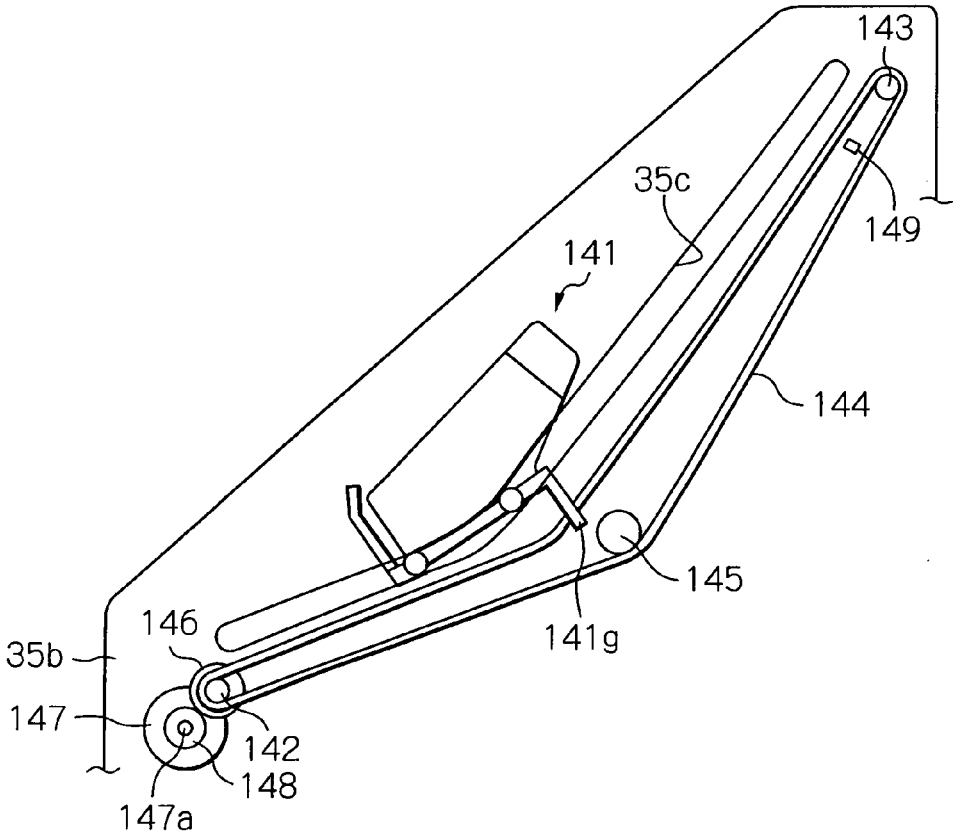
FIG. 17 is a view showing the schematic configuration of a drive mechanism of the sheet receiving board.

FIG. 17 shows the drive mechanism of the sheet receiving board 141. A first pulley 142 and a second pulley 143 are rotatably supported in the vicinity of the place where the long hole 35*c* is formed between the both side plates 35*b*. An endless belt 144 is passed over the pulleys 142 and 143. A guide roller 145 that is rotatably supported between the both side plate 35*b* is disposed within and in contact with the endless belt 144, and the endless belt 144 is disposed below the long hole 35*c* so as to have substantially the same shape as the long hole 35*c*. Also, an attachment section 141*g* that is integrally formed on the sheet receiving board 141 is fixed to the endless belt 144.

A driving gear 146 is attached to an unshown spindle of the first pulley 142, and this driving gear 146 is held in mesh with a pinion 148 that is attached to an output shaft 147*a* of a stepping motor 147 attached to one of the side plates 35*b*, the stepping motor 147 being capable of rotating in both forward and reverse directions.

In the above-described configuration, the forward and reverse operation of the stepping motor 147 selectively reciprocates the sheet receiving board 141 between a first position for catching one end of the surface-printed sheet PA shown by the solid line in FIG. 16 and a second position where the other end of the surface-printed sheet PA placed on the upper surface contact the endless belt 38 as shown by the two-dot chain line in FIG. 16. Also, in the vicinity of the second pulley 143, there is disposed a home position sensor 149 for detecting that the sheet receiving board 141 occupies the first position, i.e., the home position.

As described above, the sheet receiving board 141 functions as sheet catching means for catching, at the first position in the vicinity of the printing unit 2, the leading edge of the surface-printed sheet PA2 guided by the switching member 10 to the auxiliary tray 8, and opening the leading edge of the surface-printed sheet PA2 at the second position that is closer to the upstream side of the sheet re-feeding means 9 than the first position. Moreover, the stepping motor 147, driving gear 146, pinion 148, first pulley 142, second pulley 143, endless belt 144 and guide roller 145 function as moving means for reciprocating the sheet receiving board 141 between the first position and the second position.

According to the third embodiment, the path where the sheet receiving board 141 reciprocally moves is configured at a tile so as to be substantially the same as the path for dropping the surface-printed sheet PA onto the auxiliary tray 8. Accordingly, the surface-printed sheet PA on which printing is performed by the printing unit 2 is conveyed while being received by the sheet receiving board 141 near the path where the surface-printed sheet PA moves, whereby the upper surface of the sheet receiving board 141 can smoothly catch the surface-printed sheet PA, and a conveyance jam can be prevented from occurring, even if the sheet conditions, image conditions, environmental conditions and the like fluctuate.

The sheet catching means and the moving means are not limited to those described above, and thus may be the moving guide (81) and moving means (87) serving as sheet holding means in place of the sheet catching means, as shown in, for example, FIG. 1 through FIG. 9 of Japanese Unexamined Patent Application Publication No. 2005-262730. According to the duplex printing apparatus described in this publication, even the leading edge of a soft sheet can be inserted without resistance, and the leading edge of a surface-printed sheet can be held securely and excellently. Moreover, it is possible to provide a duplex printing apparatus having a configuration simpler than that of a conventional single-step duplex printing apparatus having a one-plate cylinder and one-pressing means duplex printing apparatus capable of preventing increase of the installation space, i.e., a new duplex printing apparatus that does not require the sheet re-feeding storing means of the conventional duplex printing apparatus. In addition, a surface-printed sheet delivered from the printing unit and a surface-printed sheet located in the sheet re-feeding means are prevented from contacting each other so that stain generated by friction between the surface-printed sheets can be prevented from occurring. Accordingly, a conveyance jam of the surface-printed sheets can be prevented from occurring, and the surface-printed sheets can be conveyed stably without causing the surface-printed sheets to meander or skew. Thus there are effects that an image to be printed can be prevented from tilting during printing, and the resist is prevented from deteriorating because of the tilt.

Next, the slow-up operation performed during duplex printing according to the first example is described with reference to FIG. 18.

Hereinafter, the first embodiment that is applied to the duplex printing apparatus 1 having the sheet receiving board 141 of the abovementioned third embodiment is described. In the printing states and simplified timing charts shown in FIG. 18 and FIG. 19 through FIG. 21 according to the examples described later, "drum rotation" represents the rotation of the plate cylinder 12, and the drum speed represents the rotation speed of the plate cylinder 12, i.e., the printing speed. Moreover, each arrow in "sheet feeding (sheet feeding board)" represents a sheet feeding period for feeding a sheet P from the sheet feeding board 67, each arrow in "sheet receiving board" represents a conveying period for conveying a surface-printed sheet PA on the sheet receiving board 141, each arrow in "sheet re-feeding resist member" represents an activation period in which the sheet re-feeding resist roller 23 is activated, and "print pressure solenoid status" represents ON/OFF (activated/deactivated) status of the print pressure solenoid 181.

The simplified timing charts shown in FIG. 18 through FIG. 21 only show the timings at which the main components, members and drive means are operated. However, not only these elements but also other components and drive means of the above-described duplex printing apparatus 1 are included. Furthermore, the following examples shown in FIG. 18 through FIG. 21 respectively relate to the slow-up control of printing speed obtained when duplex printing is started, thus a small number of duplex prints is used to describe each example for simplification of description. However, each example is not limited to this number.

When printing is started in the simplex printing mode, the slow-up operation is carried out until the printing speed changes from a low speed to a set speed, while a single sheet is fed every rotation of the plate cylinder to perform printing. In the duplex printing mode as well, when duplex printing is started, the slow-up operation is performed until the printing speed changes from the low speed to the set speed as in the simplex printing mode.

During the duplex printing mode, as shown in FIG. 18 and described in detail in the first embodiments through the third embodiments, surface printing and reverse printing are performed at one rotation of the plate cylinder, without performing surface printing on the first single sheet and reverse printing on the last sheet. However, surface printing and reverse printing on the $N^{th}$ sheet (N is a natural number) are not performed during the same rotation of the plate cylinder, but are performed alternately in each rotation. Specifically, at the first rotation of the plate cylinder when duplex printing is started, not reverse printing but surface printing is performed on the first sheet. Then, at the second rotation of the plate cylinder, surface printing is performed on the second sheet and reverse printing is performed on the first sheet. In this manner, duplex printing on one sheet is completed.

During this duplex printing, duplex printing on the first sheet is started at a low speed which is the lowest set speed of the duplex printing apparatus, and the printing speed is increased to a set speed in each rotation of the plate cylinder. Specifically, every time when the plate cylinder is rotated once in response to feeding of each sheet to the printing unit when duplex printing is started, the printing speed is subjected to the slow-up operation so as to be increased from the low speed to the set speed.

As shown in FIG. 16 and FIG. 18, when duplex printing is started, the first sheet P for surface printing in duplex printing is fed from the sheet feeding board 67 at the first rotation of the plate cylinder 12. The sheet P is then moved to the cam plate 43B at the second rotation of the plate cylinder 12. Surface printing is performed on the first delivered sheet, which is conveyed to the sheet re-feeding conveyance unit 25 by the sheet receiving board 141, and then the leading edge of thus obtained surface-printed sheet PA stops at the position of the sheet re-feeding positioning member 24. At this moment, the first surface-printed sheet PA for duplex printing, which has stopped at the position of the sheet re-feeding positioning member 24, is pressed at its leading edge against the peripheral surface of the press roller 13 by the lifting movement of the sheet re-feeding resist roller 23. The surface-printed sheet PA is then fed again to the printing unit 2 while being turned along the peripheral surface of the press roller 13, whereby reverse printing on the first sheet for duplex printing is ended. The sheet is further guided to the sheet discharging conveyance unit 85 by the switching member 10, conveyed by the sheet discharging conveyance unit 85, and discharged to and accumulated on the catch tray 86.

This operation is repeated to continuously execute the duplex printing. The last sheet for duplex printing, after surface printing on the last sheet is performed, is not fed at a rotation for performing reverse printing. Also, only the same reverse printing as the one described above is executed without performing surface printing. Specifically, the last surface-printed sheet PA for duplex printing that has stopped at the position of the sheet re-feeding positioning member 24 is pressed at its leading edge against the peripheral surface of the press roller 13 by the lifting operation of the sheet re-feeding resist roller 23, and thereby turned/re-fed to the printing unit 2. In this manner, reverse printing on the last sheet for duplex printing is completed, and duplex printing on the set number of prints is completed.

The position where the rotation speed of the plate cylinder 12 is changed is not the home position of the plate cylinder 12 (called "HP" hereinafter) but the front surface region of the plate cylinder 12 that has been rotated approximately 140 degrees from HP. Since a sheet P is delivered from the sheet feeding board 67, information on the rotation speed of the plate cylinder 12 needs to be transmitted to the control means 129 responsible for controlling feeding of the sheet, thus the time corresponding to the abovementioned angle is required.

Therefore, when duplex printing is started, a sheet is conveyed in response to a drum rotation (rotation of the plate cylinder 12) when the printing speed is increased to the set speed in each rotation of the plate cylinder 12, as shown in FIG. 18. At the first speed (60 rpm) of the first drum rotation, the first sheet for surface printing is delivered from the sheet feeding board 67 to perform surface printing in the printing unit 2, and thus obtained surface-printed sheet PA is conveyed to the sheet re-feeding conveyance unit 25 by the sheet receiving board 141. At this moment, however, the drum speed (rotation speed of the plate cylinder 12) enters the second rotation and thus increases to become the second speed (75 rpm) when printing pressure is applied to the surface-printed sheet PA.

Therefore, while the first surface-printed sheet PA for duplex printing is conveyed to the sheet re-feeding conveyance unit 25 by the sheet receiving board 141, the drum speed changes. In this case, if only the speed of conveying the sheet PA is increased by the increase of the drum speed, a problem occurs in which the first surface-printed sheet PA that has been conveyed too far is bent at the section between the lower surface 10*a* of the switching member 10 and the peripheral surface of the press roller 13 since the sheet is guided to the auxiliary tray 8 via the small space between the lower surface 10*a* of the switching member 10 and the peripheral surface of the press roller 13. Also, another problem occurs in which the lower surface 10*a* of the switching member 10 is pressed excessively and thereby deformed.

For this reason, the conveyance speed of the sheet receiving board 141 needs to be controlled such that it increases in synchronization with the drum speed. Consequently, sheets can be conveyed without problems.

It should be noted that the printing speed is different between surface printing and reverse printing performed on the same single printed sheet PB. Therefore, a difference in image density might occur. However, by providing a known print pressure adjusting mechanism (see, for example, the pressing force changing means 20 shown in FIG. 1 of Japanese Unexamined Patent Application Publication H10-44577) to perform print pressure control such that the print pressure is larger at the time of reverse printing than the print pressure obtained at the time of surface printing, the image density difference can be reduced.

As described above, in the present example, the control means 129 controls, on the basis of a drum rotation position signal and a drum speed signal from the home position sensor 134 and an unshown encoder sensor, the drive means of the sheet feeding unit 4, printing unit 2, sheet re-feeding means 9, sheet discharge unit 6 and switching member 10, such that the printing speed (drum speed) slows up from a low speed to a set speed in each rotation of the plate cylinder in response to feeding of each sheet P to the printing unit 2 when duplex printing is started, i.e., such that the operations/timings of the drive means/members shown in FIG. 18 are satisfied. The control means 129 further controls the stepping motor 147 of the sheet re-feeding means 9 such that the conveyance speed of the sheet receiving board 141 synchronizes with the printing speed (drum speed).

Next, the slow-up operation performed during duplex printing according to the second example is described with reference to FIG. 19.

In the first example described above, the conveyance speed of the sheet receiving board 141 needs to be controlled such that it increases in synchronization with the drum speed. However, this complicates the control of conveyance because the conveyance speed of the sheet receiving board 141 needs to be set in accordance with the drum speed, and because the drum speed does not increase constantly in accordance with the speed of each rotation. Therefore, as shown in FIG. 19, the invention of this second example enables the slow-up operation to be performed on the printing speed so that it increases from a low speed to the set speed, every time when performing simplex printing of duplex printing, without performing control of synchronizing the conveyance speed of the sheet receiving board 141 is not synchronized with the drum speed.

Figure 19:
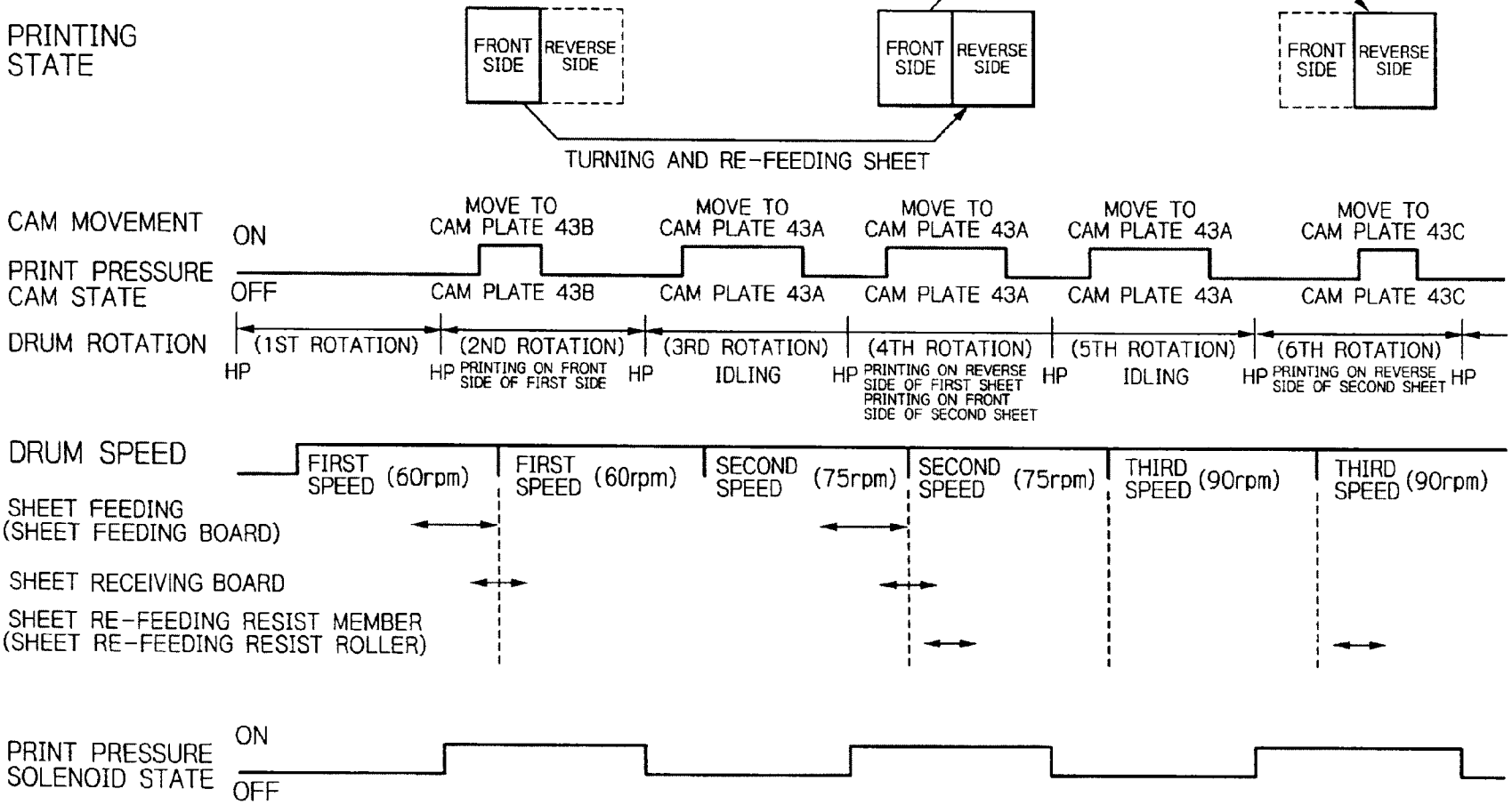
FIG. 19 is a view including a timing chart for explaining the slow-up operation in duplex printing in the second example of the present invention.

As shown in FIG. 19, when duplex printing is started, at the first speed (60 rpm) of the first drum rotation, the first sheet for surface printing is delivered from the sheet feeding board 67 to perform surface printing, thus obtained surface-printed sheet PA is conveyed to the sheet re-feeding conveyance unit 25 by the sheet receiving board 141 during the second drum rotation, and then the leading edge of this sheet PA is caused to stop at the position of the sheet re-feeding positioning member 24. At this moment, both the drum speed of the first drum rotation and the drum speed of the second drum rotation are set to the same first speed (60 rpm), whereby the conveyance speed of the sheet receiving board 141 becomes the same as the drum speed. Consequently, it is not necessary to synchronize the conveyance speed with the drum speed.

At the third drum rotation, the print pressure solenoid 181 is switched off to remove print pressure. Specifically, the drum is idled with respect to the plate cylinder 12 so as not to press the press roller 13. This idling is used to change the drum speed to the second speed (75 rpm) to deliver the second surface-printed sheet P from the sheet feeding board 67. Then, at the fourth drum rotation surface printing is performed in the printing unit 2, and the conveyance speed of the sheet receiving board 141 for conveying thus obtained surface-printed sheet PA is set to the same speed as the drum speed (second speed: 75 rpm). Subsequently, the same duplex printing operation is repeated to perform duplex printing while increasing the printing speed to the set speed.

Since the third drum rotation is used as idling rotation in order to set the conveyance speed of the sheet receiving board 141 to the same speed as the drum speed, thus surface printing cannot be performed on the second sheet P to be sent, as in the first example described above. However, although sheets are fed every other rotation (every two rotations) of the plate cylinder 12 by using this method, the slow-up operation can be performed at the time of duplex printing, without synchronizing the conveyance speed of the sheet receiving board 141 with the rotation speed of the plate cylinder 12.

Moreover, the time for drying the surface-printed sheet PA can be ensured by using the idling. It should be noted that the printing speed is different between surface printing and reverse printing performed on the same single printed sheet PB. Therefore, a difference in image density might occur. However, by providing the known print pressure adjusting mechanism (see, for example, the pressing force changing means 20 shown in FIG. 1 of Japanese Unexamined Patent Application Publication H10-44577) to perform print pressure control such that the print pressure is larger at the time of reverse printing than the print pressure obtained at the time of surface printing, the image density difference can be reduced.

As described above, in the present example, the control means 129 controls, on the basis of the drum rotation position signal and the drum speed signal from the home position sensor 134 and the unshown encoder sensor, the drive means of the sheet feeding unit 4, printing unit 2, sheet discharge unit 6, sheet re-feeding means 9 and switching member 10, such that the printing speed slows up from a low speed to a set speed in each simplex printing in duplex printing, i.e., for every two rotations of the plate cylinder when duplex printing is started, i.e., such that the operations/timings of the drive means/members shown in FIG. 19 are satisfied. The control means 129 further controls the press roller attaching/detaching mechanism 55 (print pressure solenoid 181) of the printing unit 2 in each rotation of the plate cylinder.

Next, the slow-up operation performed during duplex printing according to the third example is described with reference to FIG. 20.

During the duplex printing mode, surface printing and reverse printing are performed at one rotation of the plate cylinder, as described above. However, surface printing and reverse printing are not performed at the same rotation of the plate cylinder, but are performed alternately in each rotation. Specifically, at the first rotation of the plate cylinder when duplex printing is started, not reverse printing but surface printing is performed on the first sheet. Then, at the second rotation of the plate cylinder, surface printing is performed on the second sheet and reverse printing is performed on the first sheet. In this manner, duplex printing on one sheet is completed.

Therefore, a single printed matter that is being subjected to slow-up printing in duplex printing is subjected to surface printing and reverse printing at different printing speeds.

It is known that in stencil printing the image densities of an obtained printed matter fluctuate due to the difference in the printing speed. Such phenomenon occurs because the press roller 13 facing the ink roller 16 presses the plate cylinder 12 at the time of printing, and thereby the time required when the ink within the plate cylinder 12 bleeds on a sheet through the plate cylinder 12 and the simplex master varies according to the printing speed.

Therefore, there is devised a printing method that does not cause a difference in the printed image density between the surface-printed side and the reverse-printed side of a printed matter that is being subjected to slow-up printing in duplex printing.

Figure 20:
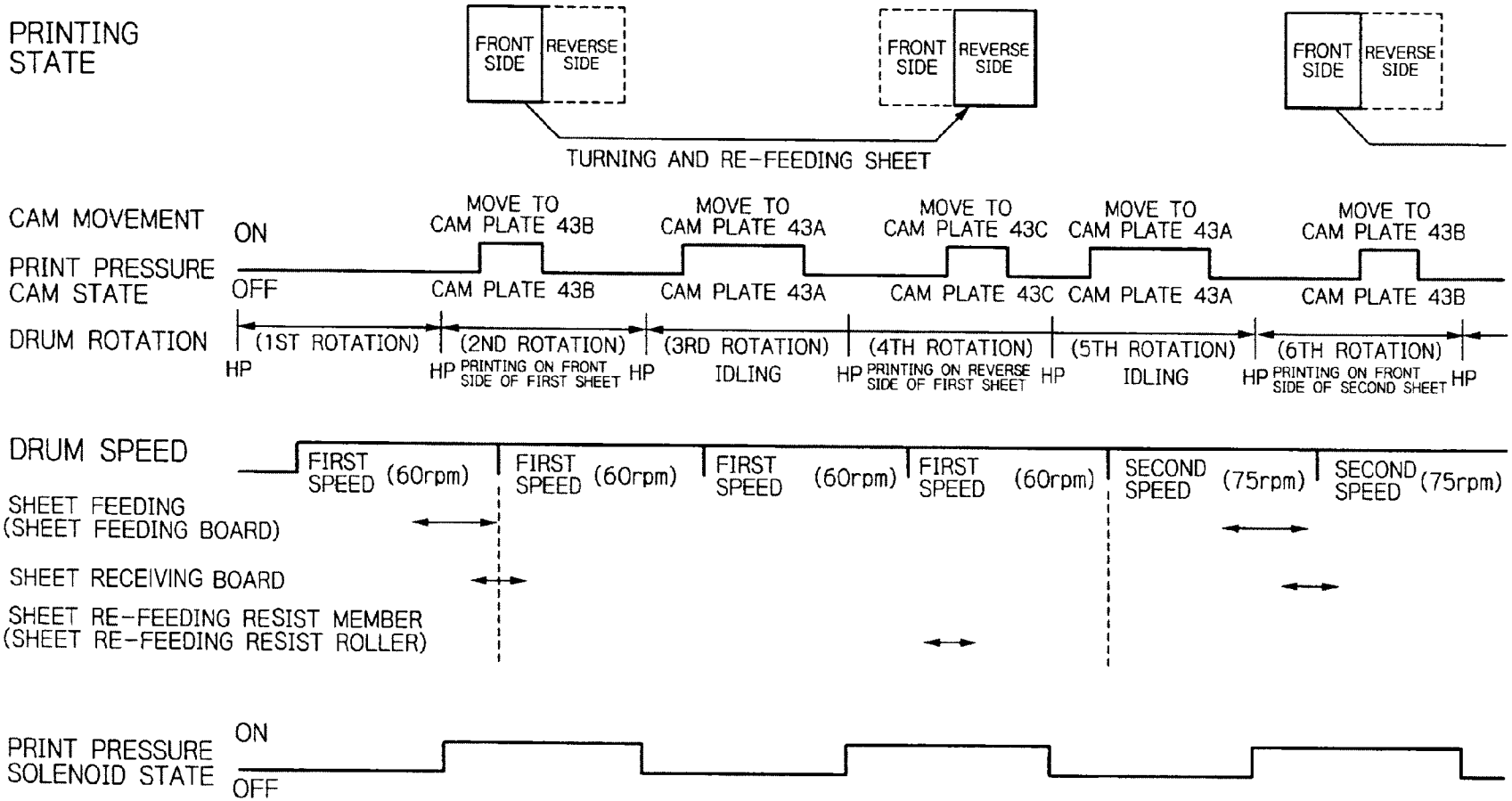
FIG. 20 is a view including a timing chart for explaining the slow-up operation in duplex printing in the third example of the present invention.

As shown in FIG. 20, when duplex printing is started, at the first speed (60 rpm) of the first drum rotation, the first sheet for surface printing is delivered from the sheet feeding board 67 to perform surface printing, thus obtained surface-printed sheet PA is conveyed to the sheet re-feeding conveyance unit 25 by the sheet receiving board 141 during the second drum rotation, and then the leading edge of this sheet is caused to stop at the position of the sheet re-feeding positioning member 24. At this moment, both the first speed (60 rpm) of the first drum rotation and the printing speed of the second rotation are set to the same first speed (60 rpm), whereby the conveyance speed of the sheet receiving board 141 becomes the same as the rotation speed (printing speed) of the plate cylinder 12. Consequently, it is not necessary to synchronize the conveyance speed of the sheet receiving board 141 with the drum speed. The speed of the third drum rotation is set to the same first speed (60 rpm), and this rotation is used as idling rotation. Switching is made to the cam plate 43A during the third idling rotation in order to move the sheet from the cam plate 43A used for surface printing to the cam plate 43C used only for reverse printing. The speed of the fourth drum rotation is set to the same first speed (60 rpm) to switch to move the sheet to the cam plate 43C used only for reverse printing, and reverse printing on the first sheet for duplex printing is completed.

With the above-described operation, duplex printing is repeated while increasing the drum speed in order to slow up duplex printing speed, after duplex printing on the first sheet is completed. At the time of slow-up printing where the printing speed is increased to the set speed when duplex printing is started, the printing speed slows up from the low speed for each duplex printing, whereby duplex printing can be performed without causing a difference in image density between the front side and the reverse side of a double-printed sheet even at the time of the slow-up printing.

The duplex printing apparatus 1 of the present example has a mechanism in which a sheet cannot be moved directly from the cam plate 43B used only for surface printing to the cam plate 43C used only for reverse printing, or from the cam plate 43C to the cam plate 43B, thus cam switching has to be performed via the cam plate 43A used for duplex printing. Also, the drum speed obtained when switching is made via the cam plate 43A is switched (see the idling rotation at the fifth rotation). Moreover, the third and fifth idling rotations are used so that the time for drying a printed matter can be ensured.

As described above, in the present example, the control means 129 controls, on the basis of the drum rotation position signal and the drum speed signal from the home position sensor 134 and the unshown encoder sensor, the drive means of the sheet feeding unit 4, printing unit 2, sheet discharge unit 6, sheet re-feeding means 9 and switching member 10 in response to the printing speed (rotation speed of the plate cylinder 12) subjected to the slow-up operation, such that the printing speed slows up from a low speed to a set speed at every speed level in each duplex printing, i.e., for every four rotations of the plate cylinder when duplex printing is started, i.e., such that the operations/timings of the drive means/members shown in FIG. 20 are satisfied. The control means 129 further controls the press roller attaching/detaching mechanism 55 (print pressure solenoid 181) of the printing unit 2, every two rotations of the plate cylinder.

Next, the slow-up operation performed during duplex printing according to the fourth example is described with reference to FIG. 21.

As described in the third example shown in FIG. 20, even when performing printing during the slow-up printing when duplex printing is started, the printing method is used in which a difference in the printed image density is not caused between the surface-printed side and reverse-printed side. Consequently, it requires a long time to increase the printing speed to the set speed, because duplex printing is repeated while increasing the drum speed in order to slow-up duplex printing speed after completing duplex printing on one sheet.

Therefore, there is devised an invention in which feeding of a sheet is stopped during the slow-up operation performed on the printing speed, until the printing speed becomes the set speed when duplex printing is started, and then feeding of the sheet is started when the printing speed becomes the set speed, so that duplex printing can be performed without wasting the slow-up time.

Figure 21:
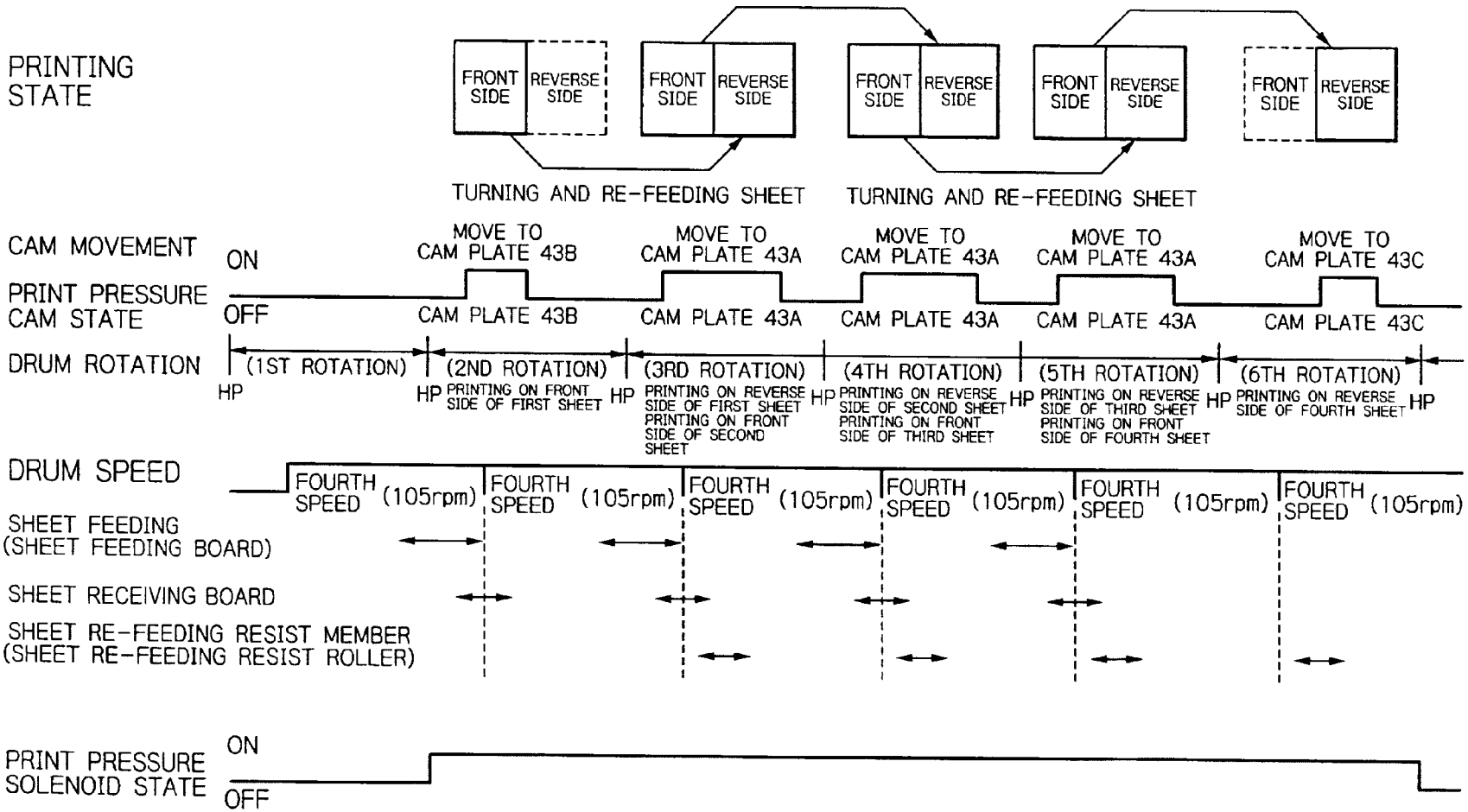
FIG. 21 is a view including a timing chart for explaining the slow-up operation in duplex printing in the fourth example of the present invention.

As shown in FIG. 21, feeding of the sheet P from the sheet feeding unit 4 is stopped during the slow-up operation performed on the printing speed, until the printing speed becomes the set speed (e.g., the fourth speed (105 rpm) in this example) when duplex printing is started. Then, when the printing speed becomes the set speed (fourth speed), feeding of the sheet P from the sheet feeding unit 4 is started. In this manner, duplex printing can be performed normally without wasting the slow-up time.

As a mechanism for controlling the image density of a stencil printing apparatus, there is the abovementioned known print pressure changing mechanism, and a print pressure adjusting mechanism is also known (see, for example, the pressing force changing means 20 shown in FIG. 1 of Japanese Unexamined Patent Application Publication H10-44577). By using such mechanisms, print pressure is applied by the print pressure changing mechanism to control the image density, whereby it is possible to respond to a rise of the image density obtained when duplex printing is started. This control is also effective in slowing up the printing speed when printing is started in the simplex print mode.

By using the print pressure changing mechanism simultaneously, sheet feeding is stopped during the slow-up operation for increasing the printing speed to the set speed at the time of duplex printing, and sheet feed is started when the printing speed becomes the set speed, whereby duplex printing can be performed from the first sheet for duplex printing without wasting the slow-up time and without generating a difference between the image density on both front and reverse sides of the sheet.

As described above, in the present example, the control means 129 controls, on the basis of the drum rotation position signal and the drum speed signal from the home position sensor 134 and the unshown encoder sensor, the drive means of the sheet feeding unit 4, printing unit 2, sheet discharge unit 6, sheet re-feeding means 9 and switching member 10, such that feeding of a sheet P is stopped temporarily by means of the drive means of the sheet feeding unit 4 during the slow-up operation performed on the printing speed, and then feeding of the sheet P is started by means of the drive means of the sheet feeding unit 4 when the printing speed slows up to the set speed, i.e., such that the operations/timings of the drive means/members shown in FIG. 21 are satisfied.

As described in the first through fourth examples with reference to FIG. 18 through FIG. 21, there are types and characteristics in the slow-up operation in duplex printing. It is troublesome for the user to select and set the characteristics when duplex printing is started.

Therefore, a duplex printing mode corresponding to the type of slow-up operation, which indicates the type of duplex printing desired by the user, is selected and displayed on the display device 120 of the operation panel 103, and the select/set keys 120*a* through 120*d* are used to select the type of slow-up operation, whereby the slow-up operation of duplex printing is automatically executed when starting printing.

At this moment, the display device 120 and the select/set keys 120*a* through 120*d* function as selecting means for selecting the duplex printing mode corresponding to the type of slow-up operation in the first through fourth examples. The control means 129 shown in FIG. 9 functions as the control means for slowing up the printing speed so as to correspond to the selected duplex printing mode, on the basis of signals from the select/set keys 120*a* through 120*d*.

The examples of the selections of the duplex printing modes corresponding to the type of the slow-up operation include the following four types of duplex printing modes in the state in which the duplex printing mode is set.

A "shorted duplex printing mode" is a duplex printing mode for slowing up the printing speed from the lowest speed in the shortest amount of time. When this mode is selected, duplex printing is performed using the duplex printing slow-up operation described in the first example in FIG. 18.

A "clean duplex printing mode" is a duplex printing mode for slowing up the printing speed from the lowest speed in the shortest amount of time when surface printing and reverse printing in duplex printing are performed, and is a mode that does not produce stain caused when the printing speed is changed in duplex printing. When this mode is selected, duplex printing is performed using the duplex printing slow-up operation described in the second example in FIG. 19.

A "cleanest duplex printing mode" is a duplex printing mode for increasing the printing speed from the lowest speed to perform duplex printing without generating a difference in image density between the surface-printed side and the reverse-printed side. When this mode is selected, duplex printing is performed using the duplex printing slow-up operation described in the third example.

A "fast and clean duplex printing mode" is a printing mode for starting duplex printing when the printing speed is the set speed, and is a duplex printing mode for performing duplex printing at the highest speed and without generating a difference in image density between the surface-printed side and the reverse-printed side. When this mode is selected, duplex printing is performed using the duplex printing slow-up operation described in the fourth example in FIG. 21.

These selections "shorted duplex printing mode," "clean duplex printing mode," "cleanest duplex printing mode," and "fast and clean duplex printing mode," are displayed on the display device 120 of the operation panel 103. The user operates any one of the select/set keys 120*a* through 120*d* to, for example, display inversely in black and white and selects a mode. In this manner, the control means 129 shown in FIG. 9 controls the drive means of the respective sheet feeding unit 4, printing unit 2, sheet discharge unit 6 and sheet re-feeding means 9 so as to execute the slow-up operation selected from the four types of duplex printing modes, on the basis of an output signal from the selected one of the select/set keys 120*a* through 120*d*. Accordingly, automatic change is made to the slow-up operation corresponding to the duplex printing mode desired by the user. As a result, duplex printing desired by the user can be performed automatically.

As described above, by selecting the displayed four duplex printing modes, duplex printing slow-up operation can be automatically executed when printing is started, but it is troublesome for the user to select/set the printing mode each time.

Therefore, there is an idea of providing changing means for changing the four types of duplex printing modes to a duplex printing mode that is normally used, the four types of duplex printing modes being set beforehand as, for example, the initial conditions when setting up the duplex printing apparatus, and determining the type of duplex printing desired by the user.

For example, the "shortest duplex printing mode" of the four types of duplex printing modes is taken as the duplex printing mode that is normally used and displayed on the display device 120, and the user operates the select/set keys 120*a* through 120*d* to select this mode.

At this moment, the select/set keys 120*a* through 120*d* function as the changing means for changing to the normally used printing mode in accordance with the type of slow-up operation. The control means 129 shown in FIG. 9 functions as means for controlling the drive means of the respective sheet feeding unit 4, printing unit 2, sheet discharge unit 6 and sheet re-feeding means 9, so as to perform the slow-up operation corresponding to the "shortest duplex printing mode" as the normally used duplex printing mode, on the basis of the output signal from any one of the select/set keys 120*a* through 120*d*. As a result, the slow-up operation corresponding to the duplex printing mode desired by the user can be automatically executed.

Furthermore, selection can be made by re-pressing the select/set keys 120*a* through 120*d* so that the selected item can be changed.

The present invention can be applied not only to the above-described duplex printing apparatus 1 but also to the duplex printing apparatus having a configuration shown in FIG. 1 of Japanese Unexamined Patent Application Publication No. 2005-262730.

According to the present invention, the following effects are obtained.

(1) The control means controls the drive means of the respective sheet feeding means, printing means, sheet discharging means, sheet re-feeding means and switching means, such that the printing speed slows up from a low speed to a set speed when duplex printing is started. Therefore, duplex printing can be performed in the same manner as the simplex printing.

(2) The control means controls the drive means of the respective sheet feeding means, printing means, sheet discharging means, sheet re-feeding means and switching means, such that the printing speed slows up from the low speed to the set speed in each rotation of the plate cylinder, the rotation corresponding to feeding of each paper to the printing means. Therefore, duplex printing can be performed normally even when slow-up printing is performed.

(3) The control means controls the drive means of the respective sheet feeding means, printing means, sheet discharging means, sheet re-feeding means and switching means, such that the printing speed slows up from the low speed to the set speed in each simplex printing in duplex printing. Therefore, duplex printing can be performed normally even when slow-up printing is performed.

(4) The control means controls the drive means of the respective sheet feeding means, printing means, sheet discharging means, sheet re-feeding means and switching means, such that the printing speed slows up from the low speed to the set speed in each sheet to be subjected to duplex printing. Therefore, duplex printing can be performed without generating a difference in image density between the front side and the reverse side of a sheet in duplex printing, even when slow-up printing is performed.

(5) The control means controls the drive means of the respective sheet feeding means, printing means, sheet discharging means, sheet re-feeding means and switching means, such that sheet feeding is temporarily stopped by means of the sheet feeding means while the printing speed slows up from the low speed to the set speed when duplex printing is started, and sheet feeding is started by means of the sheet feeding means when the printing speed slows up to the set speed. Therefore, duplex printing can be performed normally without wasting the slow-up time.

(6) The control means controls the drive means of the respective sheet feeding means, printing means, sheet discharging means, sheet re-feeding means and switching means on the basis of a signal from the selecting means, such that the slow-up operation corresponding to the duplex printing mode selected from the selecting means is performed. Therefore, the user can simply select a desired duplex printing mode by using the selecting means so that desired duplex printing can be performed at the time of duplex printing.

(7) The control means controls the drive means of the respective sheet feeding means, printing means, sheet discharging means, sheet re-feeding means and switching means on the basis of a signal from the changing means, such that the normally used duplex printing mode is executed. Therefore, the user can simply select a desired duplex printing mode by using the changing means so that desired duplex printing can be performed at the time of duplex printing.

Various modifications will become possible for those skilled in the art after receiving the teachings of the present disclosure without departing from the scope thereof.

What is claimed is:

1. A duplex printing apparatus, comprising:

a printing unit, which includes a plate cylinder around which a duplex master is wrapped, the duplex master including two images of a first engraved image and a second engrave image formed next to each other along a direction of rotation of the plate cylinder, and a pressing unit which is attached or detached with respect to the plate cylinder in a relative manner;

a sheet feeding unit which feeds a sheet toward the printing unit;

a sheet discharging unit which discharges a printed sheet printed by the printing unit;

a sheet re-feeding unit which temporarily holds a surface-printed sheet, the front side of which is formed with a printed image by the printing unit so as to correspond to the first engraved image or the second engraved image, thereafter sends the surface-printed sheet to the pressing unit, and turns the surface-printed sheet by rotating the pressing unit to re-feed the surface-printed sheet to the printing unit;

a switching unit which guides the sheet, which has passed through the printing unit, to the sheet re-feeding unit or the sheet discharging unit; and a control unit configured to control drive units of the sheet feeding unit, printing unit, sheet discharging unit, sheet re-feeding unit and switching unit respectively, so that printing speed increases from a low speed to a set speed when duplex printing is started, wherein, at the time of duplex printing, a first sheet is fed to the printing unit by the sheet feeding unit to perform, on the front side of the first sheet, surface printing corresponding to either one of the first engraved image and the second engrave image, thus obtained first surface-printed sheet on which printing is performed is guided to the sheet re-feeding unit by the switching unit, thereafter a second sheet is fed to the printing unit by the sheet feeding unit to perform, on the front side of the second sheet, surface printing corresponding to either one of the first engraved image and the second engraved image, and to re-feed the first surface-printed sheet to the printing unit by the sheet re-feeding unit to perform, on the reverse side of the first surface-printed sheet, reverse printing corresponding to the other one of the first engraved image and the second engraved image, and thus obtained first duplex-printed sheet is guided to the sheet discharging unit by the switching unit, while thus obtained second surface-printed sheet is guided to the sheet re-feeding unit, wherein the sheet re-feeding unit includes a sheet receiving board which catches a leading edge of the surface-printed sheet guided by the switching unit to an auxiliary tray, wherein the control unit is configured to control the drive units of the sheet feeding unit, printing unit, sheet discharging unit, sheet re-feeding unit and switching unit respectively, such that the printing speed increases in each simplex printing performed in duplex printing, and wherein the plate cylinder performs idling rotation every time when performing simplex printing of duplex printing until the printing speed increases from a low speed to a set speed and, during the idling rotation of the plate cylinder, the printing speed is increased by one speed level.

2. The duplex printing apparatus as claimed in claim 1, wherein the sheet receiving board moves between a first position and a second position, the sheet receiving board catches the leading edge of the surface-printed sheet in the first position and places a trailing edge of the surface-printed sheet, opposite the leading edge of the surface-printed sheet, in the second position.

3. The duplex printing apparatus as claimed in claim 2, wherein the sheet receiving board is disposed closer to the pressing unit in the first position than in the second position.

4. The duplex printing apparatus as claimed in claim 2, wherein the sheet receiving board includes an attachment section, the attachment section is fixed to an endless belt, and the endless belt moves the sheet receiving board between the first position and the second position.

5. The duplex printing apparatus as claimed in claim 1, wherein a print pressure adjustment mechanism is provided for controlling the printing pressure in accordance with the printing speed so as to reduce a difference in image density occurred between the front side and the reverse side of the sheet.

6. A duplex printing apparatus, comprising:

a printing unit, which includes a plate cylinder around which a duplex master is wrapped, the duplex master including two images of a first engraved image and a second engrave image formed next to each other along a direction of rotation of the plate cylinder, and a pressing unit which is attached or detached with respect to the plate cylinder in a relative manner;

a sheet feeding unit which feeds a sheet toward the printing unit;

a sheet discharging unit which discharges a printed sheet printed by the printing unit;

a sheet re-feeding unit which temporarily holds a surface-printed sheet, the front side of which is formed with a printed image by the printing unit so as to correspond to the first engraved image or the second engraved image, thereafter sends the surface-printed sheet to the pressing unit, and turns the surface-printed sheet by rotating the pressing unit to re-feed the surface-printed sheet to the printing unit;

a switching unit which guides the sheet, which has passed through the printing unit, to the sheet re-feeding unit or the sheet discharging unit;

a control unit configured to control drive units of the sheet feeding unit, printing unit, sheet discharging unit, sheet re-feeding unit and switching unit respectively, so that printing speed increases from a low speed to a set speed when duplex printing is started; and a selecting unit which selects one of the first through fourth duplex printing modes corresponding to the increasing printing speed, wherein, at the time of duplex printing, a first sheet is fed to the printing unit by the sheet feeding unit to perform, on the front side of the first sheet, surface printing corresponding to either one of the first engraved image and the second engrave image, thus obtained first surface-printed sheet on which printing is performed is guided to the sheet re-feeding unit by the switching unit, thereafter a second sheet is fed to the printing unit by the sheet feeding unit to perform, on the front side of the second sheet, surface printing corresponding to either one of the first engraved image and the second engraved image, and to re-feed the first surface-printed sheet to the printing unit by the sheet re-feeding unit to perform, on the reverse side of the first surface-printed sheet, reverse printing corresponding to the other one of the first engraved image and the second engraved image, and thus obtained first duplex-printed sheet is guided to the sheet discharging unit by the switching unit, while thus obtained second surface-printed sheet is guided to the sheet re-feeding unit, wherein the sheet re-feeding unit includes a sheet receiving board which catches a leading edge of the surface-printed sheet guided by the switching unit to an auxiliary tray, the sheet receiving board including a pair of side fences provided on sides of the sheet receiving board perpendicular to width direction of the sheet and an end fence provided on an end side of the sheet receiving board, the end fence being perpendicular to the pair of side fences, wherein the control unit is configured to control the drive units of the sheet feeding unit, printing unit, sheet discharging unit, sheet re-feeding unit and switching unit respectively in a first duplex printing mode, such that the printing speed increases in each rotation of the plate cylinder, which corresponds to feeding of every sheet to the printing unit, wherein the control unit is configured to control the drive units of the sheet feeding unit, printing unit, sheet discharging unit, sheet re-feeding unit and switching unit respectively in a second duplex printing mode, such that the printing speed increases in each simplex printing performed in duplex printing, wherein the control unit is configured to control the drive units of the sheet feeding unit, printing unit, sheet discharging unit, sheet re-feeding unit and switching unit respectively in a third duplex printing mode, such that the printing speed increases every time when a sheet is subjected to duplex printing, wherein the control unit is configured to control the drive units of the sheet feeding unit, printing unit, sheet discharging unit, sheet re-feeding unit and switching unit respectively in a fourth duplex printing mode, such that feeding of a sheet is temporarily stopped by the sheet feeding unit while the printing speed increases, and feeding of the sheet is started by the sheet feeding unit when the printing speed increases to the set speed, and wherein the control unit is configured to control the drive units of the sheet feeding unit, printing unit, sheet discharging unit, sheet re-feeding unit and switching unit respectively on the basis of a signal sent from the selecting unit, such that the printing speed increases in response to the duplex printing mode selected by the selecting unit.

7. The duplex printing apparatus as claimed in claim 6, wherein the duplex printing mode is set beforehand as initial conditions of the duplex printing apparatus.

8. The duplex printing apparatus as claimed in claim 7, further comprising a changing unit which changes each of the first through fourth duplex printing modes to a duplex printing mode that is normally used, wherein the control unit is configured to control the drive units of the sheet feeding unit, printing unit, sheet discharging unit, sheet re-feeding unit and switching unit respectively on the basis of a signal sent from the changing unit, such that the normally used duplex printing mode is executed.

* * * * *

UNITED STATES PATENT AND TRADEMARK OFFICE

CERTIFICATE OF CORRECTION

PATENT NO. : 7,882,781 B2
APPLICATION NO. : 11/772567
DATED : February 8, 2011
INVENTOR(S) : Mituru Takahashi It is certified that error appears in the above-identified patent and that said Letters Patent is hereby corrected as shown below:

Column 22, line 18, change “Bc” to --8c--.

Signed and Sealed this
Fourteenth Day of June, 2011

David J. Kappos

David J. Kappos
*Director of the United States Patent and Trademark Office*